US007417398B2

(12) United States Patent
Kozaki et al.

(10) Patent No.: US 7,417,398 B2
(45) Date of Patent: Aug. 26, 2008

(54) VACUUM PUMP

(75) Inventors: Junichiro Kozaki, Kyoto (JP); Yoshio Tsunazawa, Kyoto (JP); Akira Arakawa, Kyoto (JP); Masaki Ohfuji, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 142 days.

(21) Appl. No.: 11/606,014

(22) Filed: Nov. 30, 2006

(65) Prior Publication Data

US 2007/0145929 A1 Jun. 28, 2007

(30) Foreign Application Priority Data

Dec. 21, 2005 (JP) ..... 2005-368241

(51) Int. Cl.
*F04D 19/04* (2006.01)
*F04B 49/10* (2006.01)

(52) U.S. Cl. ..... 318/471; 417/32; 417/423.4

(58) Field of Classification Search ..... 318/471; 415/175; 417/32, 44.1, 63, 228, 279, 423.4, 417/423.14

See application file for complete search history.

(56) References Cited

U.S. PATENT DOCUMENTS 6,123,522 A * 9/2000 Kubo et al. ..... 417/423.4
6,599,108 B2 * 7/2003 Yamashita ..... 417/423.4
6,832,888 B2 * 12/2004 Kabasawa et al. ..... 415/90
6,926,493 B1 * 8/2005 Miyamoto et al. ..... 415/90
7,090,469 B2 * 8/2006 Blumenthal et al. ..... 417/32
2002/0090309 A1 * 7/2002 Yamashita ..... 417/423.4
2004/0081560 A1 * 4/2004 Blumenthal et al. ..... 417/32
2006/0153696 A1 * 7/2006 Ransom et al. ..... 417/228
2007/0278884 A1 * 12/2007 Kozaki et al. ..... 310/90.5
2008/0131288 A1 * 6/2008 Kozaki ..... 417/32

* cited by examiner

*Primary Examiner*—Bentsu Ro
(74) *Attorney, Agent, or Firm*—Manabu Kanesaka

(57) ABSTRACT

A vacuum pump includes at least one magnetic body located on a circle about a rotor rotational axis and having a Curie temperature within a rotor temperature monitoring range; an inductance detecting portion facing the circle so as to establish a gap between the circle and the inductance detecting portion, for detecting a change of magnetic permeability of the magnetic body as an inductance change when the magnetic body rotates; and a carrier generation device generating a carrier signal for providing in the inductance detecting portion. An A/D conversion device samples a detection signal of the inductance detecting portion synchronously with a carrier generation by the carrier generation device, and converts the detection signal to a digital signal. A determination device determines whether or not a temperature of the rotor exceeds a predetermined temperature, based on the change of the magnetic permeability of the magnetic body.

9 Claims, 16 Drawing Sheets

FIG. 8 (a) Positional information signal Fsig (t)

FIG. 8 (b) Carrier signal Fcarrier (t)

FIG. 8 (c) Modulated wave $F_{AM}$ (t)

FIG. 8 (d) Fstd (t)

FIG. 8 (e) Differential signal Fsub (t)

FIG. 8 (f) Digitizing sensor signal e (t)

FIG. 8 (g) After adjusting for gain and offset Digitizing sensor signal

FIG. 9 (a) Displacement signal

FIG. 9 (b) Carrier signal

FIG. 9 (c) Sensor signal

FIG. 9 (d) A/D converter synchronized with maximum value

FIG. 9 (e) A/D converter synchronized with minimum value

FIG. 9 (f) A/D converter synchronized with non-maximum value and non-minimum value

VACUUM PUMP

BACKGROUND OF THE INVENTION AND RELATED ART STATEMENT

The present invention relates to a vacuum pump determining a rotor temperature using the Curie temperature of a magnetic body.

In a turbo-molecular pump, an aluminum alloy is generally used as the rotor material. In the aluminum alloy, an allowable creep deformation temperature is relatively low (approximately 120° C.~140° C.), so that when a pump is operated, it is required to be constantly monitored in order that the temperature of the rotor may be kept below the allowable temperature. Accordingly, a non-contact method for detecting the temperature of the rotor by using the phenomenon that the magnetic permeability of a ferromagnetic body greatly changes at the Curie temperature, is also known (for example, refer to Japanese Patent Publication No. H7-5051). In this conventional method, a ring-shaped ferromagnetic body is installed around a rotor, and the change of the magnetic permeability of the ferromagnetic body in Curie temperature is detected by an inductance detection coil.

However, if the carrier signal frequency applied to the coil is low, the sensor signal can be easily distorted by the rapid change of the magnetic permeability or the gap between the magnetic body and sensor. In order to prevent the above-mentioned distortion, generally, the carrier signal is required to be set at a high frequency. On the other hand, in order to meet a sampling theorem at the time of digitalization, if the carrier signal frequency is high, the sampling frequency is also required to be high. However, if the sampling frequency is high, a DSP or CPU with a low frequency operation may not be able to handle it, so that an expensive high-frequency-compliant DSP or CPU has to be used. As a result, the cost increases.

The present invention has been made to obviate the problems in the conventional vacuum pump.

Further objects and advantages of the invention will be apparent from the following description of the invention.

SUMMARY OF THE INVENTION

A first aspect of the invention relates to a vacuum pump exhausting gas by rotating a rotor relative to a stator, comprising: at least one magnetic body located on a circumference of a circle and configured to circle about a rotor rotational axis, the magnetic body having a Curie temperature within a rotor temperature monitoring range; an inductance detecting portion facing the circle so as to establish a gap between the circle and the inductance detecting portion, the inductance detecting portion being configured to detect a change of magnetic permeability of the magnetic body as an inductance change, when the magnetic body rotates therepast; a carrier generation means generating a carrier signal provided in the inductance detecting portion; an A/D conversion means sampling a detection signal of the inductance detecting portion synchronously with a carrier generation by the carrier generation means, and converting the detection signal to a digital signal; and a determination means wherein the digital signal from the A/D conversion means is input, and determining whether or not the temperature of a rotor surpasses a predetermined temperature based on the change of the magnetic permeability of the magnetic body detected by the inductance detecting portion.

In the vacuum pump of the first aspect of the invention, a sampling frequency fs by the A/D conversion means meets $fs=fc/n$ relative to a frequency fc of a carrier generated by the carrier generation means. Also, the vacuum pump meets $fs \geqq f\,rotmax$ relative to the maximum rotational frequency f rotmax of the rotor. However, n=1/2, or n=1, 2, 4, 8, . . . .

A second aspect of the invention resides in the vacuum pump described in the first aspect, the sampling frequency fs meets $fs \geqq f\,rotmax \times f\,div$ when the number of detection points which should be detected at the inductance detecting portion is f div, during one rotation of the rotor.

A third aspect of the invention resides in a vacuum pump as per the first and second aspects wherein an averaging means is provided. The averaging means obtains a signal obtained by sampling the A/D conversion means with respect to an opposed interval wherein a detecting means is opposed to the magnetic body, during multiple rotations of the rotor; and averages the obtained signal, and allows the obtained signal to be a signal of the opposed interval. The determination means determines based on the averaged signal by the averaging means.

In accordance with a fourth aspect of the invention, the vacuum pump according to the first or second aspect, includes a basis magnetic body provided on the circumference of the rotor and includes the Curie temperature on a higher temperature side than the temperature monitoring range; and a differential generation means generating (a) a first differential signal between a first detection signal when a single or multiple magnetic bodies is/are opposed to the inductance detecting portion, and a second detection signal when the basis magnetic body is opposed to the inductance detecting portion; or (b) a second differential signal between an after-conversion first detection signal and an after-conversion second detection signal, after the first and second detection signals are converted by the A/D conversion means. The determination means determines whether or not the temperature of the rotor exceeds the predetermined temperature based on the second differential signal or the first differential signal after being converted by the A/D conversion means.

In accordance with a fifth aspect of the invention the vacuum pump according to the first or second aspects, includes a pair of intervals on the basis magnetic body provided on the circumference of the rotor in such a way that a distance between each interval on the basis magnetic body and the inductance detecting portion differs, and including the Curie temperature on the higher temperature side than the temperature monitoring range; and a signal correction means generating (a) a first after-correction detection signal wherein the first detection signal when the single or multiple magnetic bodies is/are opposed to the inductance detecting portion is corrected by a finite difference of a pair of detection signals obtained when the pair of intervals on the basis magnetic body are opposed to the inductance detecting portion; or (b) a second after-correction detection signal wherein the first detection signal after being converted by the A/D conversion means is corrected by the finite difference of the pair of detection signals after being converted by the A/D conversion means. The determination means determines whether or not the temperature of the rotor exceeds the predetermined temperature based on the second after-correction detection signal or the first after-correction detection signal after being converted by the A/D conversion means.

In accordance with a sixth aspect of the invention, the vacuum pump according to the fourth or fifth aspects, includes a derivative operation means conducting a derivative operation of the differential signal or after-correction detection signal. The determination means determines whether or not the temperature of the rotor exceeds the predetermined temperature based on whether or not the result of the operation of the derivative operation means is below the predetermined value.

In accordance with a seventh aspect of the invention a vacuum pump according to one of the first-sixth aspects, includes a nonlinearity correction means which is a correction parameter correcting a nonlinearity of a detecting characteristic of the inductance detecting portion, and corrects the detection signal of the inductance detecting portion. In the vacuum pump, the detection signal corrected by the nonlinearity correction means is used instead of the detection signal of the inductance detecting portion.

According to the above and other aspects of the invention, the vacuum pump which determines the temperature of the rotor by using the Curie temperature of the magnetic body and can improve the precision of the determination of the temperature while preventing the cost of the device from increasing.

DETAILED DESCRIPTION OF PREFERRED EMBODIMENTS

Hereinafter, preferred embodiments for the present invention will be explained with reference to figures.

First Embodiment

Figure 1:
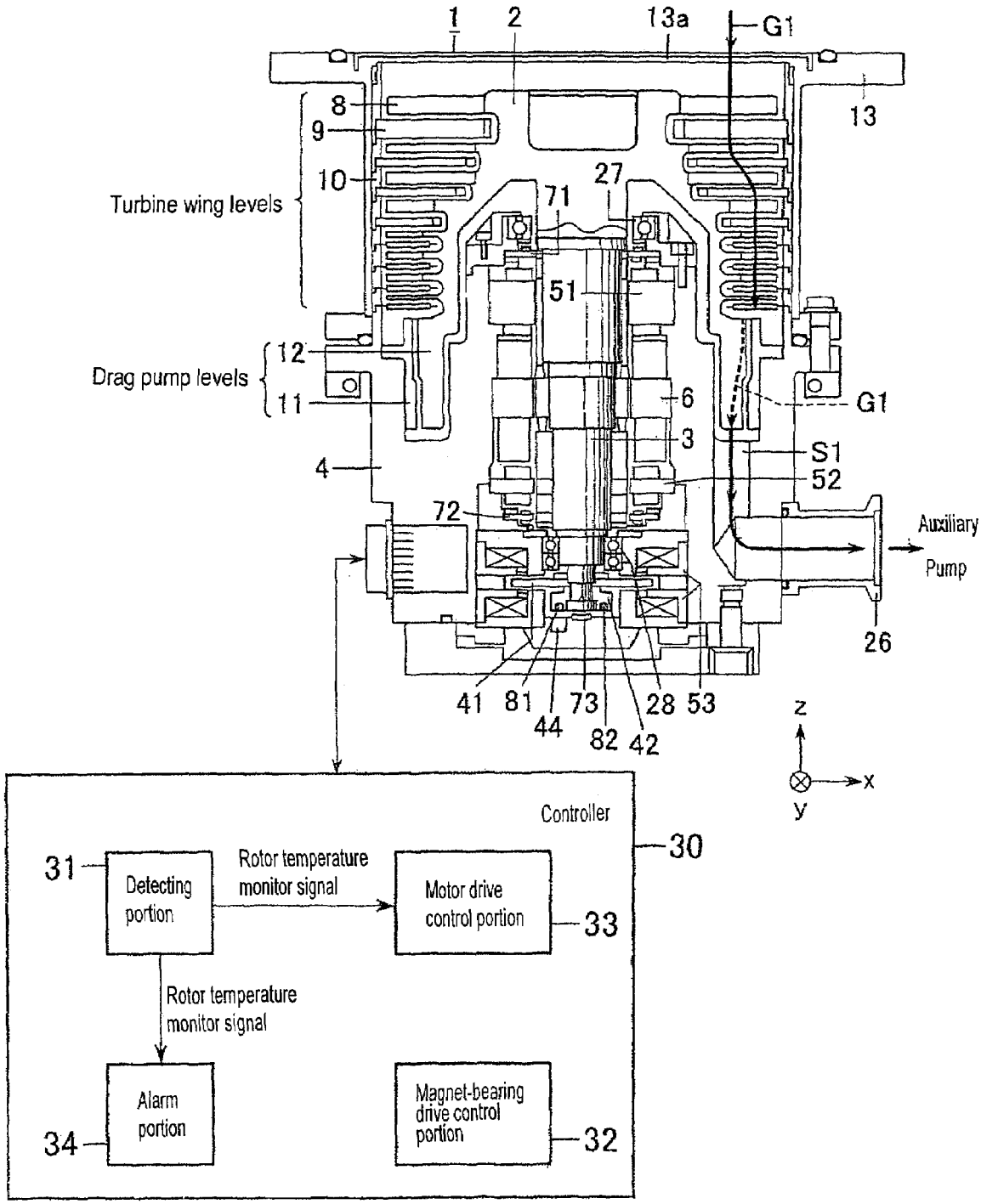
FIG. 1 is a schematic drawing showing the first embodiment of a vacuum pump according to the present invention, and shows an outline structure of a pump main body and a controller of a magnet-bearing type turbo-molecular pump.

FIG. 1 shows the first embodiment of a vacuum pump according to the present invention. This figure shows the arrangement of a pump main body 1 and a controller 30 of a magnet-bearing type turbo-molecular pump. A shaft 3 having a rotor 2, is supported without direct contact with electromagnets 51, 52, 53 that are provided in a base 4. A surfacing position of the shaft 3 is detected by radial displacement sensors 71, 72 and an axial displacement sensor 73 provided in a base 4.

A circular disk 41 is provided at the lower end of the shaft 3. The electromagnet 53 is provided in such a way as to sandwich the disk 41 from both above and below. The shaft 3 is suspended in an axial direction by attracting the disk 41 using the electromagnet 53. The disk 41 is fixed to the lower end portion of the shaft 3 by a nut 42 which rotates integrally with the shaft 3. Magnetic body targets 81, 82 are provided in this nut 42.

On the stator side, which is opposed to the nut 42, a gap sensor 44 is arranged so as to be opposed to the magnetic body targets 81, 82. The gap sensor 44 is an inductance-type gap sensor, and detects the change of the magnetic permeability of the magnetic body targets 81, 82 when the temperature of a rotor rises above an allowable temperature, in the form of an inductance change. Here, the temperature of the rotating member comprised of the rotor 2, shaft 3, nut 42 and the like, is referred to as the rotor temperature.

In the rotor 2, rotating wings or vanes 8 with multiple levels are formed along a direction of a rotational axis. Fixed wings or vanes 9 are respectively provided between the rotating vanes 8. The turbine wing levels of the pump main body 1 are constituted by the rotating wings 8 and fixed wings 9. Each fixed wing 9 is retained by spacers 10 in such a way as to be clamped from both above and below. The spacers 10 have the function of maintaining gaps between the fixed wings 9 at predetermined intervals with respect to the function of retaining the fixed wings 9.

Moreover, screw stators 11 are provided in back levels (below in the figure) of the fixed wings 9, and constitute drag pump levels. Gaps are formed between inner circumferential surfaces of the screw stators 11 and a cylinder portion 12 of the rotor 2. The fixed wings 9 retained by the rotor 2 and the spacers 10 are housed inside a casing 13 wherein an inlet 13*a* is formed. When the rotor 2 rotates the attached shaft 3 by way of a motor 6 while the electromagnets 51~53 support the shaft 3 in a contract free state, gas on an inlet 13*a* side is exhausted to a back-pressure side (space S1) in the manner of an arrow G1. The gas exhausted to the back-pressure side is exhausted through an auxiliary pump connected to an outlet 26.

The turbo-molecular pump main body 1 is controlled by the controller 30. In the controller 30, a magnet-bearing drive control portion/section 32 controls the magnet bearings; and a motor drive control portion/section 33 controls the motor 6. A detecting portion/section 31 detects whether the magnetic permeability of the magnetic body targets 81, 82 has changed or not, based on an output signal of the gap sensor 44.

The output signal of the gap sensor 44 is input into the detecting portion/section 31, and the detecting portion 31 outputs a rotor temperature monitor signal into the motor drive control portion/section 33, magnet-bearing drive control portion/section 32 and an alarm portion/section 34. Naturally, an output terminal configured to output the rotor temperature monitor signal outside the controller 30 may also/alternatively be provided. The alarm portion/section 34 is configured as an alarm means to provide alarm information indicative of an abnormal rotor temperature and the like to an operator, and constituted by a display unit displaying a speaker releasing a warning sound, or a warning and the like.

Figure 2:
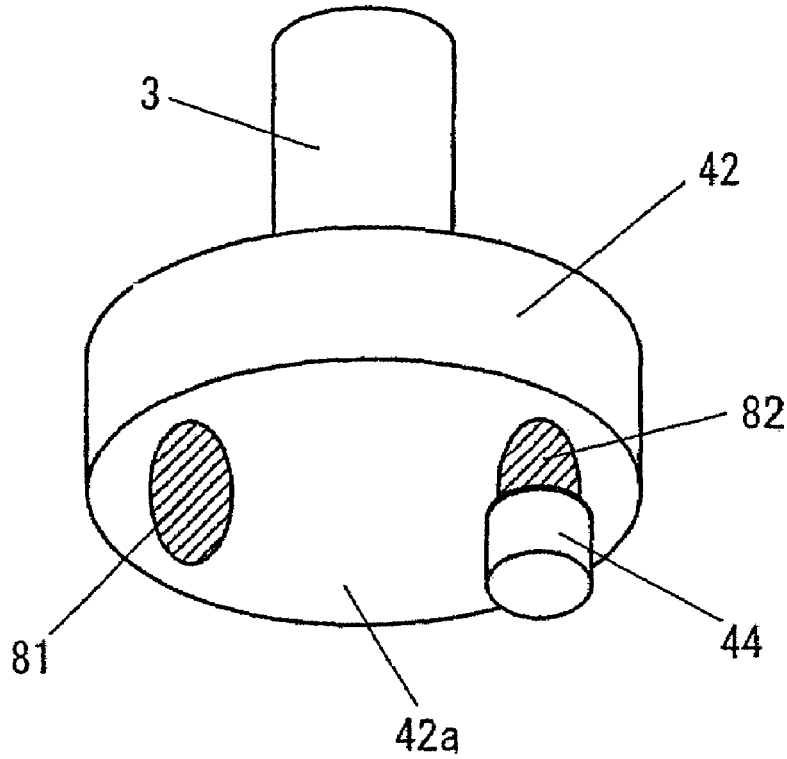
FIGS. 2(*a*) and 2(*b*) are drawings showing a relationship between a nut 42 and a gap sensor 44, wherein FIG. 2(*a*) is a perspective view, and FIG. 2(*b*) is a plan view of the nut 42 viewed from a gap sensor 44 side.
Figure 2:
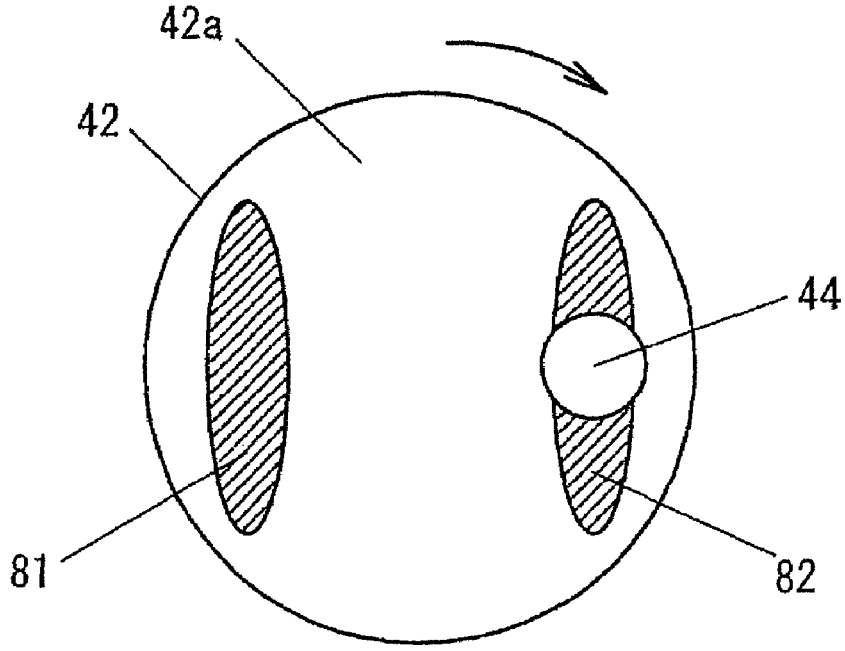

FIG. 2(*a*) is a perspective view showing the nut 42 provided on the lower end portion of the shaft and the gap sensor 44. FIG. 2(*b*) is a plan view of the nut 42 as viewed from a gap sensor 44 side. On the bottom surface of the nut 42, magnetic body targets 81, 82 are embedded by adhesion, shrink fit or the like. When the nut 42 rapidly rotates with the shaft 3, centrifugal force acts in the magnetic body targets 81, 82. However, an impact of the centrifugal force can be attenuated by providing the magnetic body targets 81, 82 on the end face of the nut 42 and locating near the axis of the rotational member. Especially, in the case wherein the magnetic body targets 81, 82 are shrunken, compressive stresses are applied to the magnetic body targets 81, 82 when the nut 42, which is heated during the shrink fit process, cools down and contracts. As a result, the attenuating effect on the effect of the centrifugal force is enhanced.

The material including a Curie temperature in a temperature range that is desirable, i.e., within a range of a temperature monitoring, is used for the material(s) of the magnetic body targets 81, 82. Generally, magnetic materials with approximately the same temperature as the maximum allowable temperature of a creep deformation of aluminum which is used for the rotor 2 (refer to FIG. 1), are used. A temperature range of approximately 120° C. of the maximum allowable temperature Tmax is set for a range of temperature monitoring. Nickel and zinc ferrite, or manganese and zinc ferrite and the like, are used for materials of the magnetic body wherein a Curie temperature Tc is approximately 120° C. In addition, here, although the same kinds of materials are used for the magnetic body targets 81, 82, materials with different Curie temperatures can be used for the magnetic body targets 81, 82, so that two different temperatures can be detected.

Exposed surfaces of the magnetic body targets 81, 82 have planes which are coincident with the plane of the bottom surface of the nut 42 (viz., are flush with the bottom of the nut), and a gap between the lower surface of the nut (hereinafter called a fixed surface) 42*a* wherein the magnetic body targets 81, 82 are fixed, and the gap sensor 44 is set at approximately 1 mm. Here, the nut 42 is made of iron, for example, pure iron. However, the Curie temperature of this material is sufficiently higher than the allowable temperature 110° C.~120° C. which is at issue in this instance, and on the high temperature side of a temperature monitoring range.

<Explanation of Inductance Change Detecting Operation>

Figure 3:
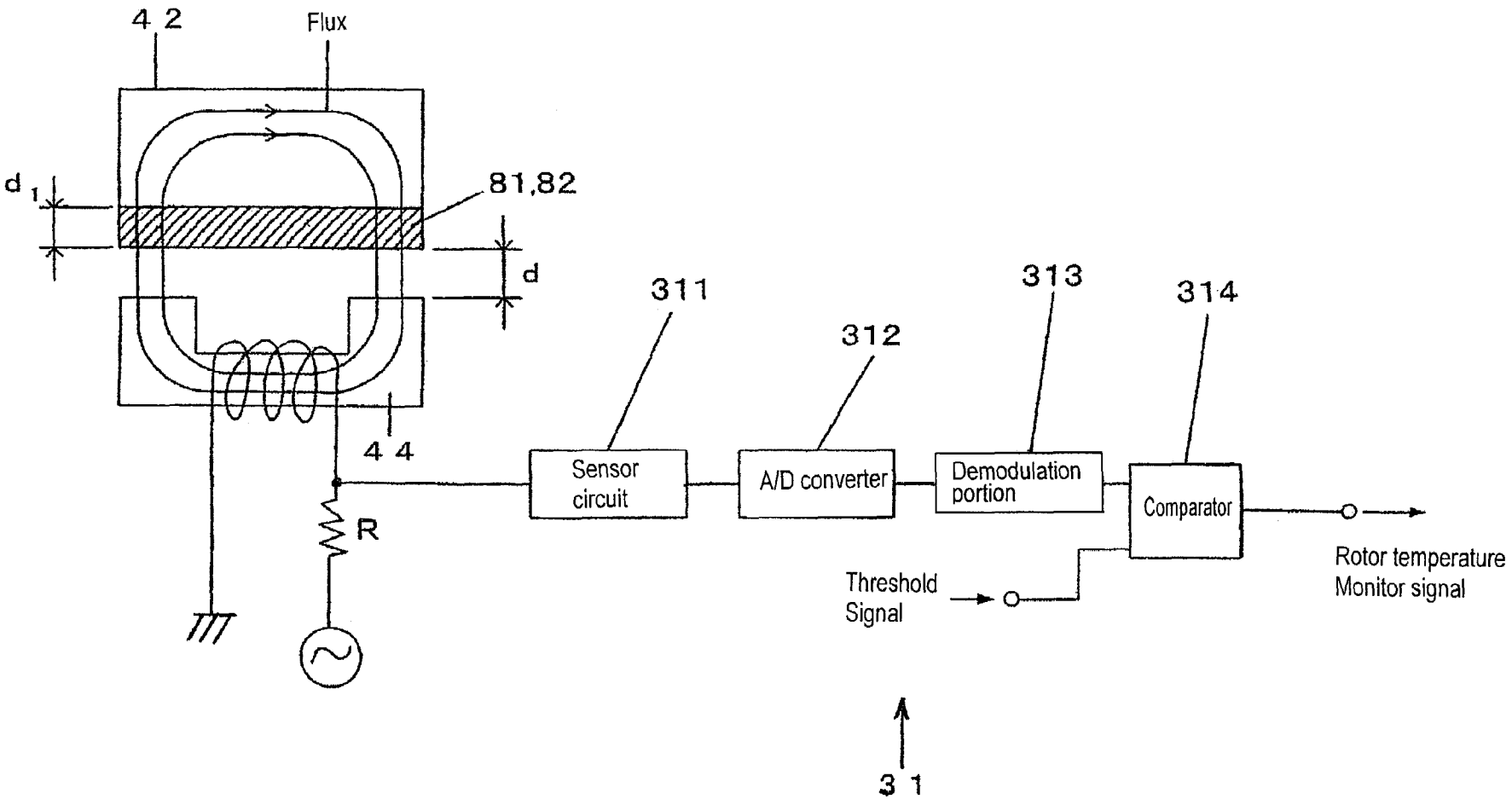
FIG. 3 is a block diagram showing details of a gap sensor 44 and a detecting portion 31.

FIG. 3 is a drawing explaining an inductance change of the gap sensor 44, and a block diagram showing details of the gap sensor 44 and the detecting portion 31. The gap sensor 44 is constituted by winding a coil around a core with large magnetic permeability such as a silicon steel plate. A high-frequency voltage is applied to the coil of the gap sensor 44 as a carrier signal, so that a magnetic circuit is formed between the gap sensor 44 and the nut 42 wherein the magnetic body targets 81, 82 are provided.

Figure 4:
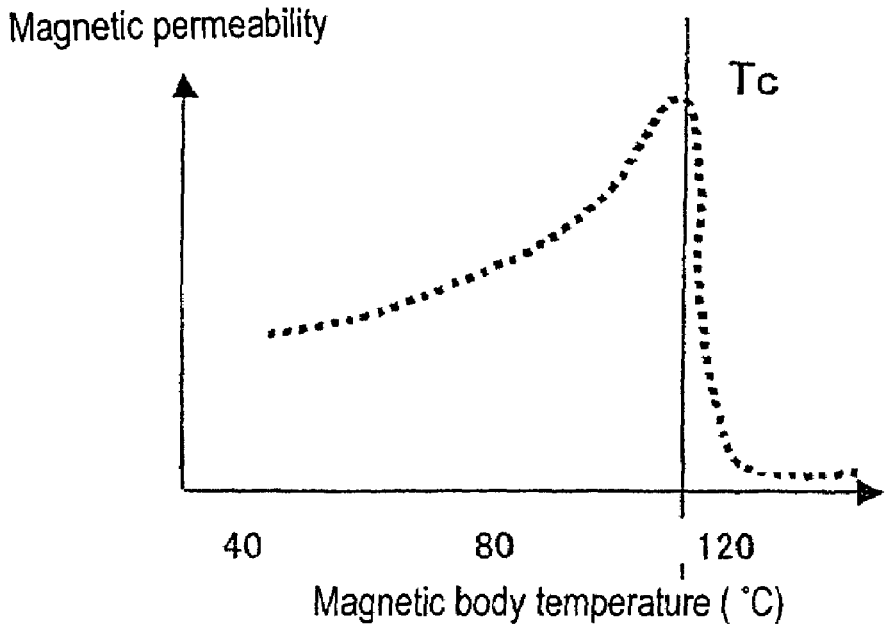
FIGS. 4(*a*) and 4(*b*) are graphs showing the changes of the magnetic permeability or an inductance relative to a temperature of a magnetic body, wherein FIG. 4(*a*) shows a change of temperature of the magnetic permeability, and FIG. 4(*b*) shows a change of the inductance.
Figure 4:
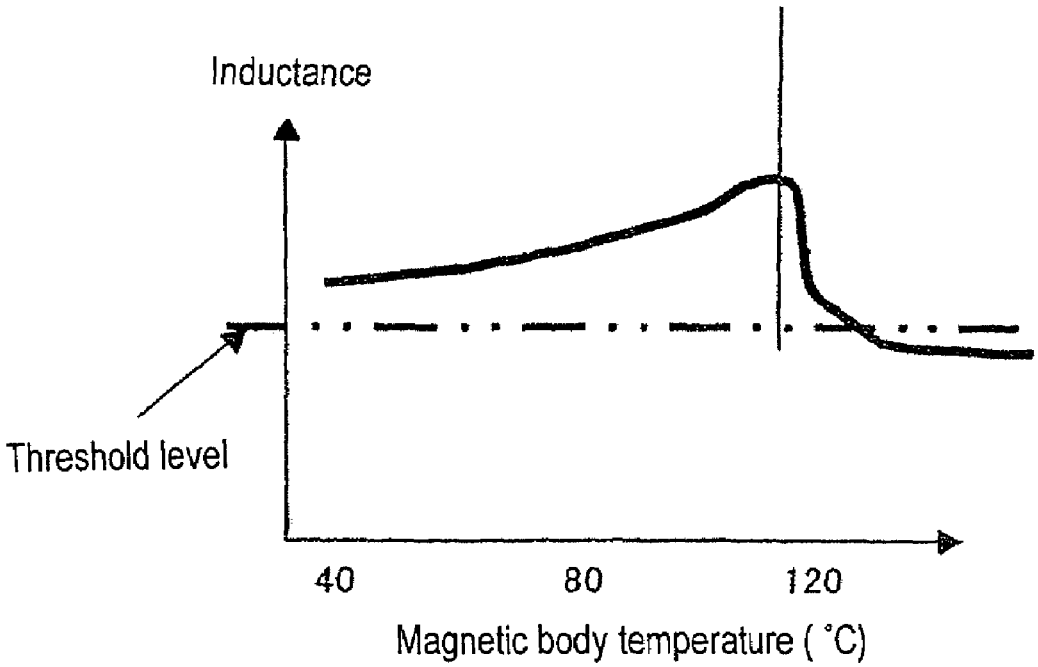

FIG. 4(*a*) shows a change of the magnetic permeability in the case of ferrite which is a typical magnetic body, and the magnetic body target 81 also includes the same character. The magnetic permeability at room temperature is lower than the magnetic permeability near the Curie temperature Tc, and when the magnetic permeability at the room temperature rises with a temperature rise and exceeds the magnetic permeability near the Curie temperature Tc, the magnetic permeability suddenly decreases. When the temperature of the magnetic body target 81 rises due to a rotor temperature rise and exceeds the Curie temperature Tc, as shown in FIG. 4(*a*), the magnetic permeability of the magnetic body target 81 suddenly decreases to the degree of approximately vacuum magnetic permeability μo. When the magnetic permeability of the magnetic body target 81 changes in a magnetic field wherein the gap sensor 44 forms, as shown in FIG. 4(*b*), the inductance of the gap sensor 44 changes.

A magnetic body such as ferrite and the like is used for a core material of the gap sensor 44; however, in the case wherein the magnetic permeability is much larger than the magnetic permeability of the air gap so that it is possible to be able to ignore the magnetic permeability of the air gap, and also, in the case wherein the leakage flux can be ignored, the relationship between inductance L and dimensions d, $d_1$ are shown approximately in the following formula (1).

$$L=N^2/\{d_1/(\mu_1\cdot S)+d/(\mu o\cdot S)\} \quad (1)$$

Note that, N represents the number of windings on the coil; S represents a cross-sectional area of the core opposed to the magnetic body target 81; d represents the air gap; $d_1$ represents the length of the magnetic path in the magnetic body target 81; and $\mu_1$ represents the magnetic permeability of the magnetic body target 81, and the magnetic permeability of the air gap is equivalent to the vacuum magnetic permeability μo.

When the rotor temperature (considered as equivalent to the temperature of the magnetic body target 81) is lower than the Curie temperature Tc, the magnetic permeability of the magnetic body target 81 is sufficiently large compared to the vacuum magnetic permeability. As a result, $d_1/(\mu_1\cdot S)$ decreases to the degree of being able to be ignored compared to $d/(\mu o\cdot S)$, so that formula (1) can approximate to the following formula (2):

$$L=N^2\cdot\mu o\cdot S/d \quad (2)$$

On the other hand, when the rotor temperature rises more than the Curie temperature Tc, approximately $\mu_1=\mu o$.

Therefore, formula (1) is represented in the following formula (3):

$$L=N^2\cdot\mu o\cdot S/(d+d_1) \quad (3)$$

More specifically, the air gap has changed from d to $(d+d_1)$, and accordingly, the inductance of the gap sensor 44 changes.

For example, the carrier signal of several tens kHz is applied to the coil of the gap sensor 44, and due to the inductance change, the amplitude of the carrier signal is modulated. The carrier signal whose amplitude is modulated is detected by a sensor circuit 311. After the sensor signal output from the sensor circuit 311 is converted to a digital signal by an A/D converter 312, the sensor signal is demodulated in a demodulation portion/section 313. As a result, a signal whose amplitude is extracted from the carrier signal whose amplitude is modulated, can be obtained.

Figure 5:
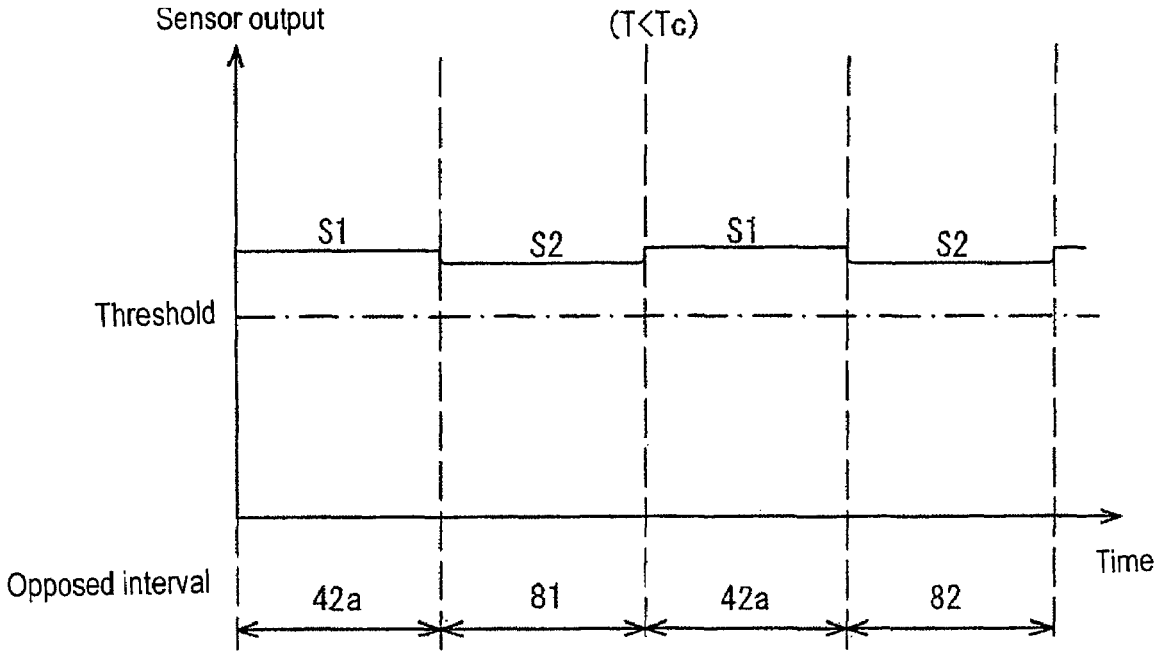
FIGS. 5(*a*) and 5(*b*) are timing charts showing examples of a signal output from a detection and rectification portion 313, wherein FIG. 5(*a*) shows a situation wherein a temperatures T of targets 81, 82 is T<Tc, and wherein FIG. 5(*b*) shows a case wherein the temperature T of the targets 81, 82 is T>Tc.
Figure 5:
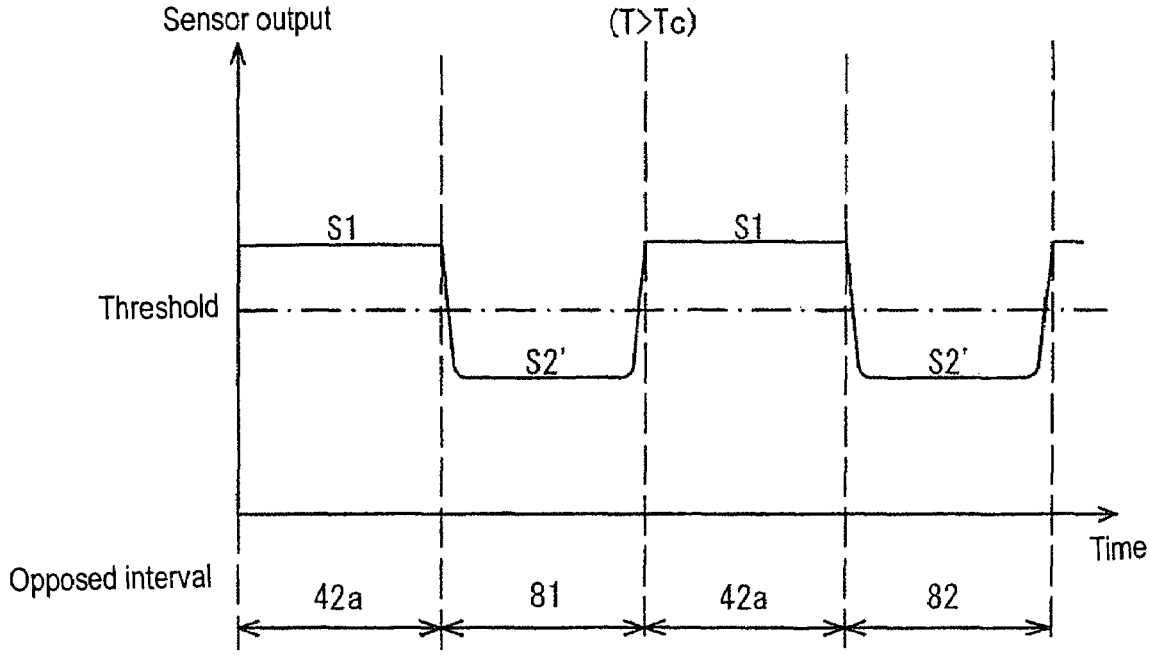

FIGS. 5(*a*), 5(*b*) show examples of a signal output from the demodulation portion 313; FIG. 5(*a*) shows a case wherein the temperatures T of the magnetic body targets 81, 82 are T<Tc; and FIG. 5(*b*) shows a case wherein the temperatures T of the magnetic body targets 81, 82 are T>Tc. As shown in FIGS. 2(*a*), 2(*b*), since the two magnetic body targets 81, 82 are provided in the nut 42, when the shaft 3 rotates once, the gap sensor 44 is opposed in the order corresponding to the magnetic body target 81, fixed surface 42*a*, target 82, and fixed surface 42*a*. In the case of T<Tc, signals S1 when the gap sensor 44 is opposed to the fixed surface 42*a*; signals S2 when the gap sensor 44 is opposed to the magnetic body target 81; signals S1 when the gap sensor 44 is opposed to the fixed surface 42*a*; and signals S2 when the gap sensor 44 is opposed to the magnetic body target 82, are output in order.

In the example shown in FIG. 5(*a*), the magnetic permeability of the nut 42 in the case of T<Tc and the magnetic permeability of the magnetic body targets 81, 82 are approximately equal, and the levels of the signals S1, S2 are approximately equal. Both signals S1, S2 have larger values than the threshold. On the other hand, FIG. 5(*b*) shows the case of T>Tc. The magnetic permeability of the magnetic body target 81 is decreased, and a signal S2' in an interval of the target 81 is decreased less than the threshold. A comparator 314 in FIG. 3 compares the level of the signal output from the modulation portion 313 to the level of a threshold signal input as a reference signal, and outputs the result as a rotor temperature monitor signal. For example, as shown in FIG. 5(*b*), when the level of the signal S2' is decreased less than the threshold level, the comparator 314 outputs a signal.

<Explanation of Sampling Frequency>

Figure 6:
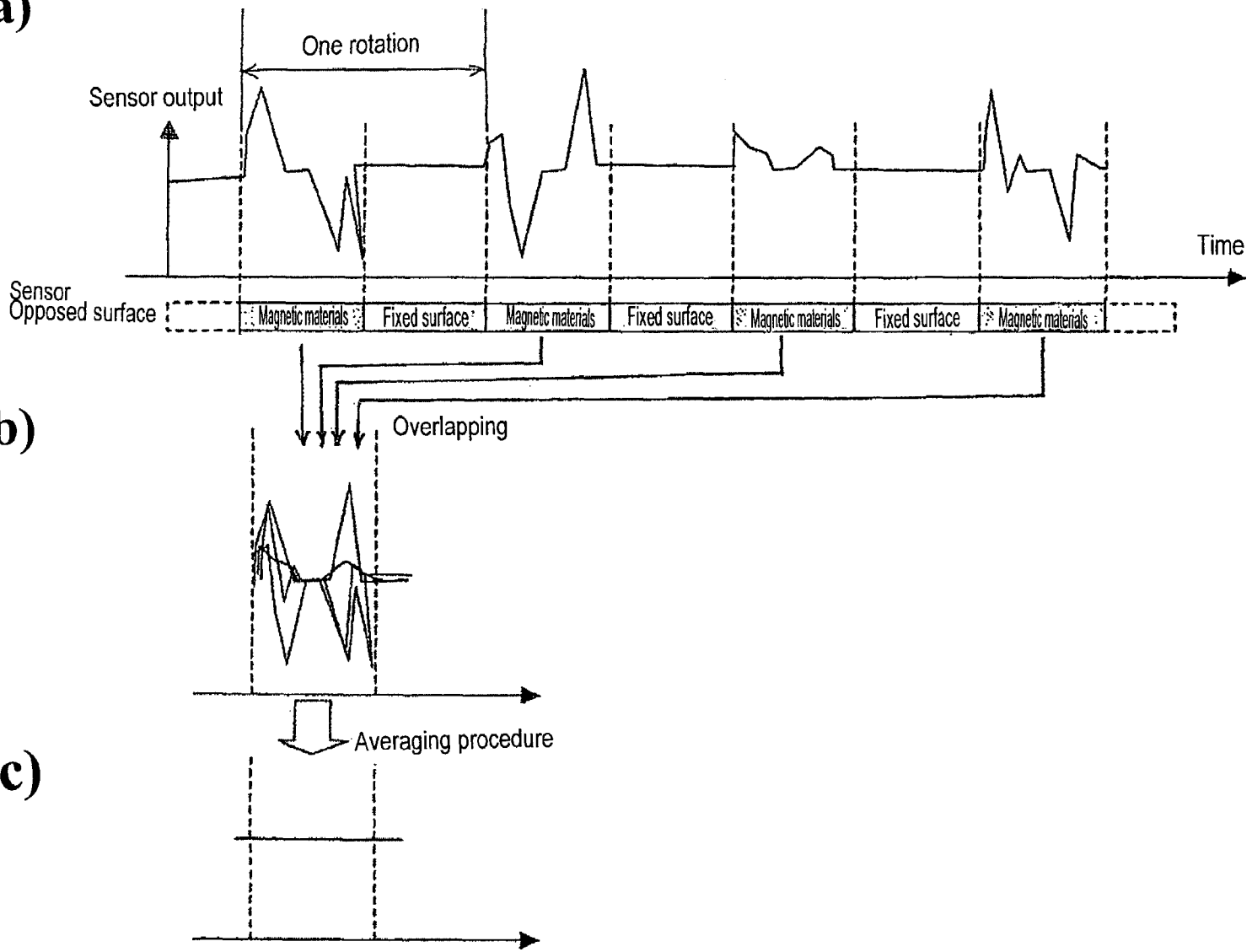
FIGS. 6(*a*) to 6(*c*) are charts, wherein FIG. 6(*a*) shows dispersion of sensor outputs, FIG. 6(*b*) shows that multiple sensor outputs of a magnetic body part are overlapped, and FIG. 6(*c*) shows a signal after averaging processing.

In the case where the carrier signal is converted by the A/D converter and the signals shown in FIGS. 5(*a*), 5(*b*) are obtained, if the carrier frequency is low, the sensor outputs vary greatly as shown in FIG. 6(*a*), due to influences such as a rapid change of the magnetic permeability near the boundary with the magnetic body targets 81, 82, or a gap between the magnetic body targets 81, 82 and the nut 42, and the like. Generally, in order to prevent the above-mentioned variety, the carrier frequency is required to be set high. In this case, the sampling speed (sampling frequency) is also required to be high, and load on a DSP (digital signal processor) which performs processing of a digitalized signal, or a CPU increases. As a result, a high-speed DSP or CPU is required, and this increases the cost.

Consequently, in the embodiment of the present invention, the relationship between the carrier frequency fc and the sampling frequency fs is set in the following formula (4), so that the sampling frequency fs and processing load can be decreased.

$$fs=fc/n \tag{4}$$

However, n=1/2, or n=1, 2, 4, 8, . . . is met.

Figure 7:
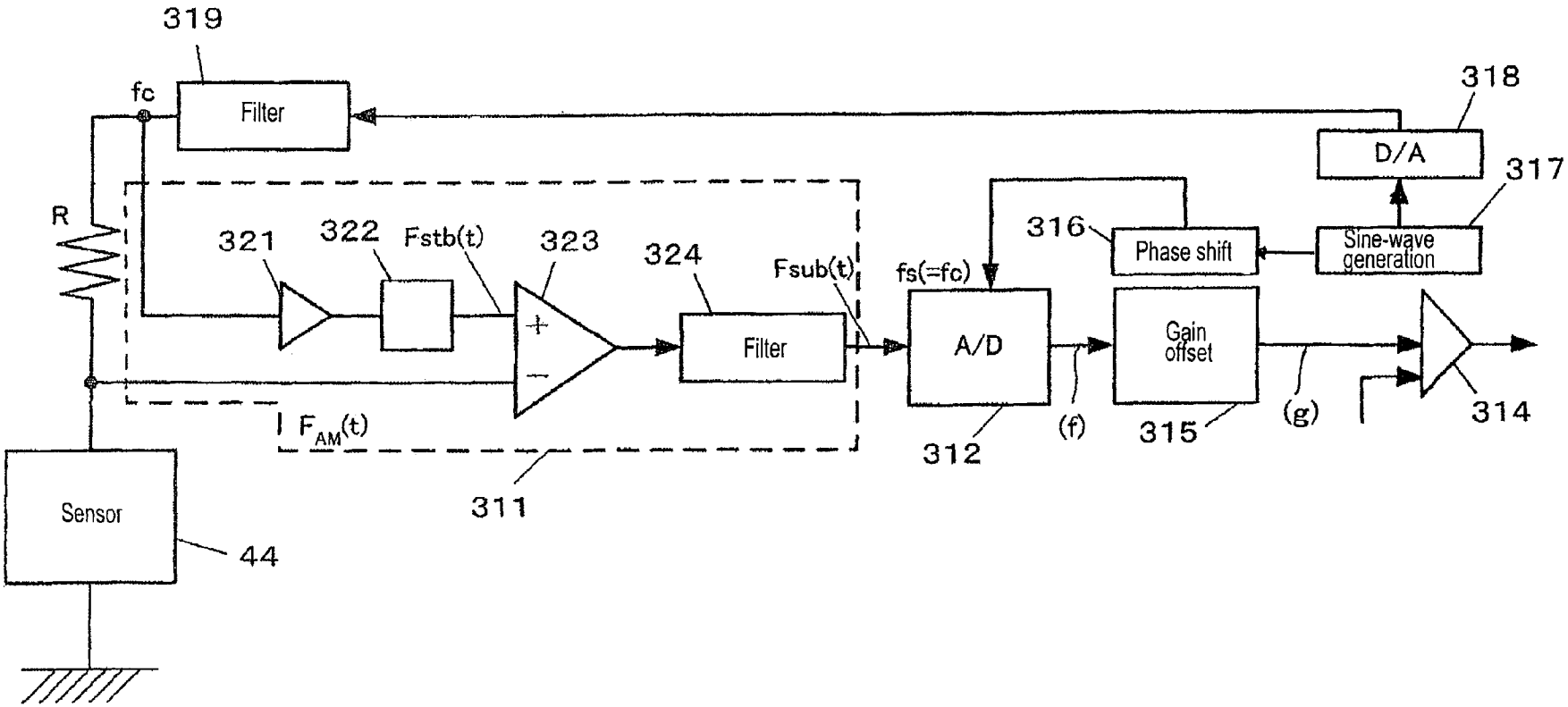
FIG. 7 is a block diagram showing a structure of the detecting portion 31 in the case wherein the detection and rectifying processing are omitted.

FIG. 7 is a block diagram showing a structure of the demodulation portion 31 in the case wherein the frequencies fc, fs are set as described above. As described later, demodulation processes can be simplified. A sine-wave discrete value generating portion 317, D/A converter 318, and filter 319 constitute a carrier generation means. The sine-wave discrete value generated at the sine-wave discrete value generating portion 317 is converted to an analog signal by the D/A converter 318, and the analog signal is outputted to the filter 319.

Since the carrier signal output from the D/A converter 318 includes a higher harmonic and a staircase pattern, a smooth carrier signal can be obtained by filtering at the filter 319 constituted by a low-pass filter or band-pass filter or the like. The carrier signal is applied to the gap sensor 44 serially connected through resistance R. A carrier signal F carrier (t) output from the filter 319 is shown in the following formula (5):

$$F\,\text{carrier}\,(t)=A\sin(2\pi fct) \tag{5}$$

The amplitude of the carrier signal applied to the gap sensor 44 is modulated by an impedance change which changes according to a surfacing position of the shaft 3, and the carrier signal becomes an amplitude-modulated wave $F_{AM}(t)$. Here, if a positional information signal is F sig(t), the amplitude-modulated wave $F_{Am}(t)$ is shown in the following formula (6). Note that the symbol ϕ represents a phase difference from the carrier signal.

$$F_{Am}(t)=(A+F\,\text{sig}(t))\sin(2\pi fct+\phi) \tag{6}$$

Figure 8:
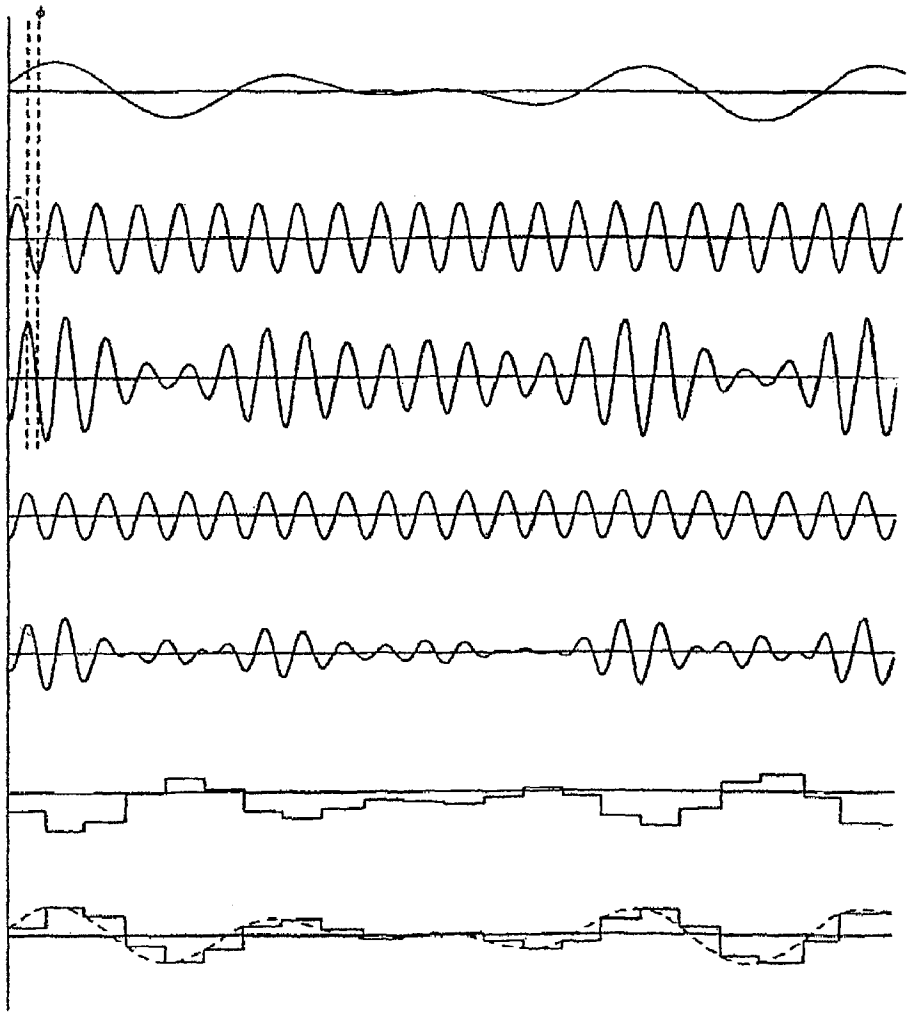
FIGS. 8(*a*)-8(*g*) are graphs showing examples of signal waveforms.

FIGS. 8(*a*)~8(*g*) are graphs showing examples of signal waveforms; FIG. 8(*a*) shows the positional information signal F sig(t); and FIG. 8(*b*) shows the carrier signal F carrier (t). If the carrier signal F carrier(t) in FIG. 8(*b*) is modulated by the positional information signal F sig(t) in FIG. 8(*a*), the amplitude-modulated wave $F_{AM}(t)$ as shown in FIG. 8(*c*) can be obtained. The amplitude-modulated wave $F_{Am}(t)$ is input into a difference amplifier 323 from the gap sensor 44.

In the difference amplifier 323, a sensor reference signal F std(t) which is shown in the following formula (7) is input with the amplitude-modulated wave $F_{Am}(t)$, and a differential signal F sub(t) between the amplitude-modulated wave $F_{Am}(t)$ and the sensor reference signal F std(t) are output from the difference amplifier 323. The sensor reference signal F std(t) is formed by adjusting gains of the carrier signal F carrier(t) by a gain-adjustment portion 321, and additionally, adjusting the phase in such a way that the carrier signal F carrier (t) has the same phase as the amplitude-modulated wave $F_{AM}(t)$ at a phase-shifting circuit 322.

$$F\,std(t)=C\sin(2\pi fct+\phi) \tag{7}$$

The sensor reference signal F std(t) has a waveform as shown in FIG. 8(*d*), and a differential signal F sub(t) shown in the following formula (8) has a waveform as shown in FIG. 8(*e*). A band-pass processing wherein the carrier frequency fc is the center frequency is provided for the differential signal F sub(t) output from the difference amplifier 323 in a filter 324.

$$\begin{aligned} Fsub(t) &= F_{AM}(t) - Fstd(t) \\ &= (A + Fsig(t) - C)\sin(2\pi fct + \phi) \end{aligned} \tag{8}$$

The differential signal F sub(t) input into the A/D converter 312 from the filter 324 is converted to a digital value by the A/D converter 312. The frequency of a digitizing signal wherein sampling is carried out by digital sampling, for example, when a sine wave with a frequency fa is sampled with a sampling frequency fb, the obtainable digitizing signal can be shown in a signal including the frequency (fa−fb).

It should be noted that, at the time of digital conversion by the A/D converter 312, the sampling is carried out based on a sine-wave discrete value generated by the sine-wave discrete value generating portion 317. However, when the carrier signal is converted by the gap sensor 44, the phase is shifted. Therefore, according to the shift, a sine-wave discrete value whose phase is shifted at a phase-shifting operation part 316 is input into the A/D converter 312. The A/D converter 312 allows timing of converting a modulated wave signal to a digital signal to approximately match with an envelope curve of the modulated wave signal. More specifically, the timing is synchronized with the maximized position of a carrier component.

Here, the case wherein the sampling frequency fs in the A/D converter 312 is equalized with the frequency fc of the carrier signal (fs=fc) will be explained. At this time, a digitizing sensor signal e(t) obtained by sampling a differential signal F sub(t) with the frequency fc is shown in the following formula (9). Note that, P=A−C, Q=sin ϕ, and both the P and Q are a constant.

$$\begin{aligned} e(t) &= (A + Fsig(t) - C)\sin\{2\pi(fc - fc)t + \phi\} \\ &= (A + Fsig(t) - C)\sin\phi \\ &= QP + QFsig(t) \end{aligned} \tag{9}$$

As evidenced by the formula (9), the digitizing sensor signal e(t) does not include a carrier, and does not require demodulated arithmetic processing. FIG. 8(*f*) shows the digitizing sensor signal e(t), and the original positional information signal F sig(t) can be extracted by adjusting offset and gain of the digitizing sensor signal e(t) by a gain and offset adjusting portion 315. FIG. 8(*g*) shows the digitizing sensor signal e(t) after adjusting for the gain and offset, and a broken line shows the positional information signal F sig(t) repeatedly. The comparator 314 compares the level of the signal output from the gain and offset adjusting portion 315 to the level of the threshold signal, and outputs the result as a rotor temperature monitor signal.

In the above-described example, the case of fs=fc is explained; however, even in the case wherein the relationship between the sampling frequency fs and the frequency fc of the carrier signal is set in fs=fc/n, the signal after digitizing does not include the carrier component, and demodulated arithmetic processing or filter processing can be simplified in a similar fashion. However, the symbol n represents 1/2 or 1, 2, 4, 8, . . . . Considering that a value in t=mTs (however, m=0, 1, 2, . . . ) is sampled, a discrete value signal obtainable by sampling the differential signal F sub(t) with the sampling frequency fs, is shown in the following formula. However, Ts=1/fs.

$$(A+F\ \mathrm{sig}(mTs)-C)\sin(2\pi fc\cdot mTs+\phi)$$

Considering the case of fs=fc/n (n=2, 4, 8, . . . ), as shown in the following formula, the result is the same as the case of the fs=fc.

$$\begin{aligned} (A + Fisg(mTs) - C)\sin(2\pi fc\cdot mTs + \phi) &= (A + Fsig(mTs) - C)\sin(2\pi n\cdot fs\cdot m/fs + \phi) \\ &= (A + Fsig(mTs) - C)\sin(2\pi n\cdot m + \phi) \\ &= (A + Fsig(mTs) - C)\sin\phi \\ &= QP + QFsig(mTs) \end{aligned}$$

Figure 9:
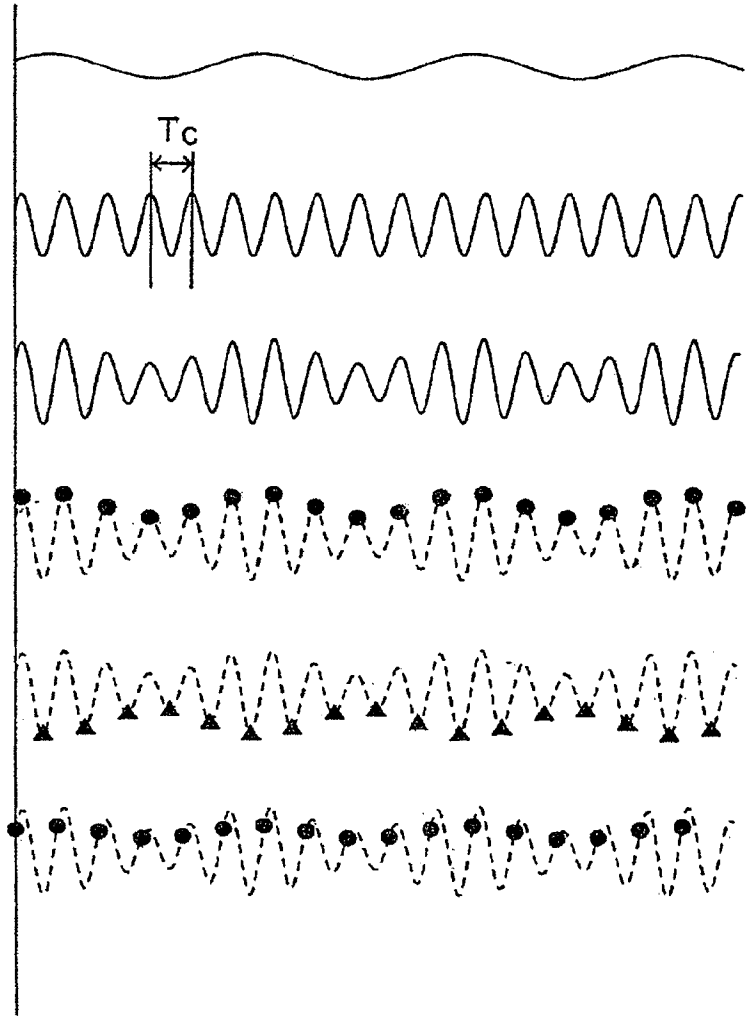
FIGS. 9(*a*)-9(*f*) are waveforms depicting sampling timings.

FIGS. 9(*a*)~9(*f*) are waveforms explaining sampling timings when samplings are carried out synchronously with the carrier signal as indicated above. In FIGS. 9(*a*)~9(*f*), FIG. 9(*a*) shows a displacement signal corresponding to the positional information signal F sig(t); FIG. 9(*b*) shows the carrier signal; and FIG. 9(*c*) shows the sensor signal wherein the carrier signal is modulated by the positional information signal. The sensor signal includes the carrier component changing with the carrier frequency. Also, FIGS. 9(*d*), 9(*e*) show sampled discrete value signals (shown by circle and triangle marks) in the case of fc=fs (i.e., the case of n=1), and sampling start timings respectively differ.

In the case of n=1, the sampling is carried out with respect to each one cycle Tc of the carrier component. In FIG. 9(*d*), the sampling timing synchronizes with a position wherein the carrier component is maximized. In FIG. 9(*e*), the sampling timing synchronizes with a position wherein the carrier component is minimized. The discrete value signals obtained by the sampling timing shown in FIG. 9(*e*) can produce the displacement signal in FIG. 9(*a*) only by reversing the plus and minus of the signal. In FIG. 9(*f*), the sampling timing synchronizes with a position which is off the maximized position and minimized position of the carrier component.

Also, in the case of n=2, the sampling is carried out with respect to each two cycles of the carrier component, so that the sampling is alternately carried out with respect to the circle and triangle marks in FIG. 9(*d*)~9(*f*). In addition, in the case of n=4, the sampling is carried out with respect to every three cycles of the carrier component. Even in the case wherein n is additionally larger, the sampling is carried out in a similar fashion.

On the other hand, in the case wherein the sampling frequency fs is set in fs=2·fc, the sampled discrete value signal is shown in the following formula.

$$(A + F\ sig(mTs) - C)\sin(2\pi\ fc\cdot mTs + \phi) = (A + F\ sig(mTs) - C)\sin(\pi\cdot m + \phi)$$

In this case, the sampling is carried out with respect to each one-half cycle of the carrier component, and if the sampling starts in such a way as to synchronize with the maximized position of the carrier component, the sampling is carried out at the circle marks in FIG. 9(*d*) at first, and for a second time, the sampling is carried out at the triangle marks in FIG. 9(*e*). More specifically, the samplings are carried out in the order corresponding to the maximized position, minimized position, maximized position, minimized position, and the like. In this case, the discrete value signal of the minimized position is reversed plus and minus, so that an envelope curve of the sensor signal shown in FIG. 9(*c*), i.e., a signal shown in FIG. 9(*a*) can be obtained.

Figure 10:
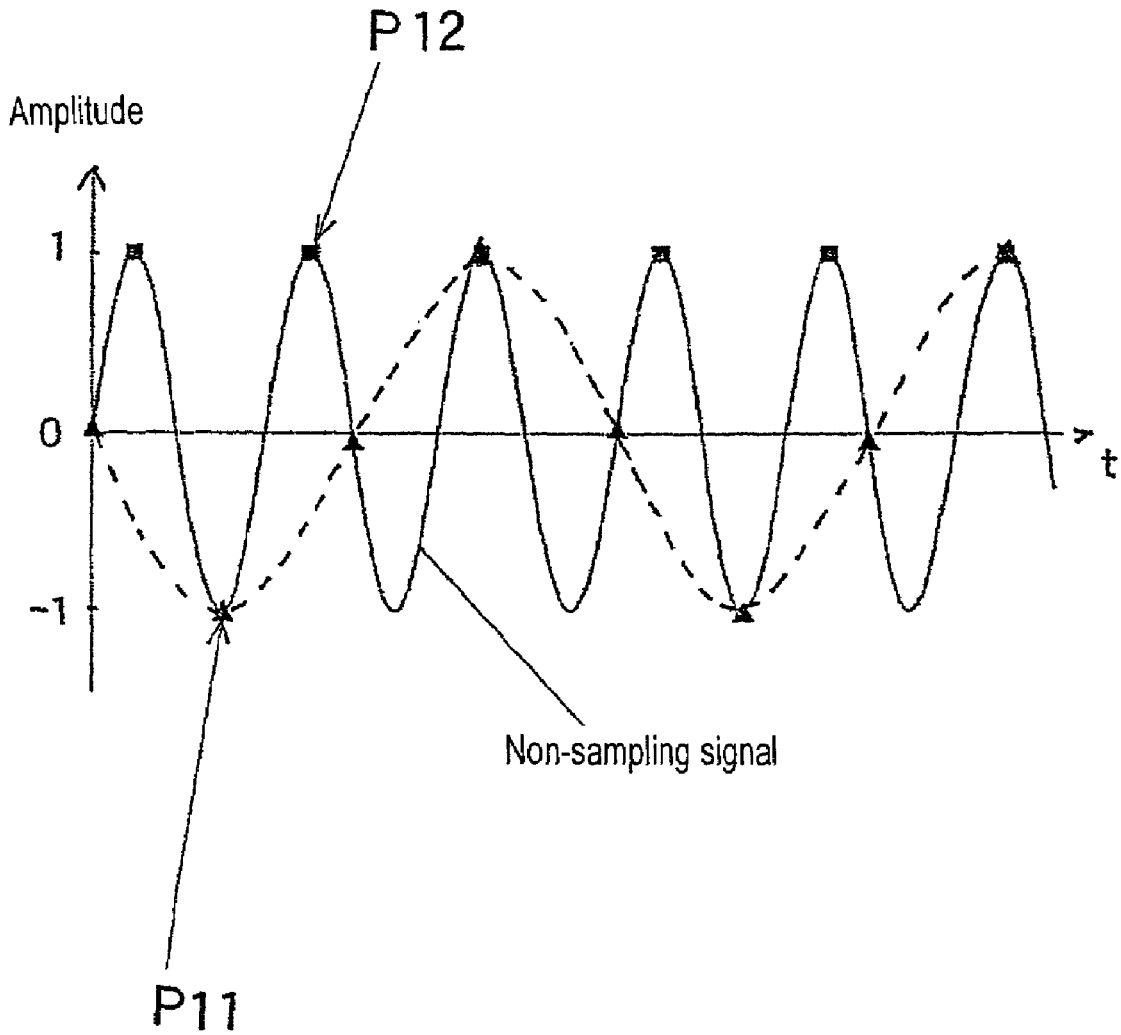
FIG. 10 is a graph explaining a sampling wherein fs=fc.

As a comparative example, the case wherein the sampling frequency fs is set in four-thirds times of the carrier frequency fc will be considered. Here, the case wherein simple sine waves (shown in full line) as shown in FIG. 10 is sampled will be examined. When a sine-wave signal shown in FIG. 10 is A/D converted by fs=(4/3) fc, the sampling is carried out at the position of triangle indicators P11 in FIG. 10. The sampled discrete value signal includes periodicity as shown by a broken line, and has a one-quarter frequency of a sampled signal (the sine-wave signal shown in full line).

In this case, the demodulated arithmetic processing is required after an A/D conversion, and a sine wave with the one-quarter frequency of the sampled signal is multiplied by A/D converted data. At this time, the sampled signal is shown in the following formula (10), and a signal wherein the sampled signal is A/D converted is shown in the following formula (11). Note that, the symbol Ts represents a sampling cycle.

$$F\ \mathrm{sample}(t) = K\sin(2\pi fct + \xi) \tag{10}$$

$$\begin{aligned} FADin &= K\sin\{2\pi(fs/4)\cdot nTs + \xi'\} \\ &= K\sin\{\pi\cdot n/2 + \xi'\} \end{aligned} \tag{11}$$

At this time, if a demodulated multiplication sine-wave signal F decode is shown in the following formula (12), a signal F detect after demodulated processing is shown in the following formula (13).

$$F\ \text{decode} = L\sin\{2\pi(fs/4)\cdot nTs + \xi'\} = L\sin\{(\pi/2)\cdot n + \xi'\} \quad (12)$$

$$F\ \text{detect} = FADin \times F\ \text{decode} = KL\sin_2\{(\pi/2)\cdot n + \xi'\} = KL\{1 - \cos(\pi n + \xi')\}/2 \quad (13)$$

Here, considering the case of L=K=1, ξ'=0, it is obvious that a signal of an amplitude 1 at F sample(t)=sin (2π fct) is attenuated to F detect=1/2. Note that, in the case of this processing, a low-pass filter processing is required in order to extract a DC component (=KL/2) after the demodulated processing. In the case of FIG. 10, since the sampling is carried out at the position of the triangle marks P11, obtained signals will be 0, −1, 0, 1, 0, −1, 0, 1, 0, . . . . If the obtained signals are multiplied by the synchronized signal of the same frequency, the obtained signals will be 0, 1, 0, 1, 0, 1, 0, 1, . . . , and if an average of these are taken, the signal will be attenuated to 0. 5.

On the other hand, as shown in the embodiment, in the case wherein the sampling is carried out under the conditions that fc=fs, the signal is sampled at the position of square marks P12 in FIG. 10, and the obtained signals as described above can be directly used as the positional information signals. As is evident from FIGS. 9(*d*) or 9(*e*), in the case wherein the sampling frequency fs is set in fs=fc/n (n≠1) or fs=2·fc relative to the carrier frequency fc, the obtained signals as described above also can be directly used as the positional information signals. If the sampling is carried out synchronized with the maximized position or minimized position of the carrier component, the S/N ratio will never be decreased.

However, as shown in FIG. 6(*a*), in the case of using a time-sharing detecting method which respectively extracts the signal when the targets 81, 82 pass through the opposed position to the gap sensor 44, the sampling frequency fs is required to meet the following condition in addition to the above-described condition. For example, in the case wherein magnetic bodies of a detecting subject are arranged over halfway of one revolution, the sampling point is 2. Accordingly, the sampling frequency has more than "number of revolutions×2". In the case wherein the magnetic bodies of the detecting subject are arranged over quarter of one revolution, the sampling point becomes 4. As a result, the sampling frequency is required to be more than "number of revolutions×4."

Usually, the number of revolutions of the turbo-molecular pump is approximately tens of thousands rpm, so that even if the sampling is carried out once with respect to each revolution, the sampling frequency of a kHz order is required. More specifically, the sampling frequency fs has to be set in more than "(number of revolutions)×(sampling point per revolution)". Therefore, if the maximized revolution number of the rotor is f rotmax (Hz); the sampling point in each magnetic body is m; and a rate to one circle of the magnetic body which is the detecting subject is R, the sampling frequency fs is required to meet the following formula (14).

$$fs \geqq f\,\text{rotmax}\cdot m/R \quad (14)$$

For example, in the case wherein one target is detected only once for one revolution, m=1, and R=1, so that "fs≧f rotmax" is obtained.

Therefore, the sampling frequency fs is required to meet fs=fc/n (n=1/2 or 1, 2, 4, 8, . . . ), and also set in such a way as to meet the following formula (14).

In the first embodiment, the following operational effect is obtained.

(1) The sampling frequency fs at the time of the A/D conversion of the sensor signal is set in such a way as to meet the fs=fc/n for the frequency fc of the carrier, and also the fs≧f rotmax for the maximized revolution frequency f rotmax of the rotor. Accordingly, the cost for the CPU or DSP can be reduced while retaining detecting precision of the change of the magnetic permeability.

(2) When the detecting point which should be detected at an inductance detecting portion, i.e., the sampling point per revolution is f div, the sampling frequency fs meets fs≧f rotmax×f div. As a result, the detecting precision can be improved.

Second Embodiment

In the first embodiment, as shown in FIGS. 5(*a*), 5(*b*), in the case wherein the sensor output signals S2, when the gap sensor 44 is opposed to the magnetic body targets 81, 82, become smaller than the threshold as shown by the signals S2', the rotor temperature monitor signals are output.

However, with the temperature change, the shaft 3 wherein the nut 42 is fixed by thermal expansion extends axially, and dimensions of the gap between the magnetic body targets 81, 82 and the gap sensor 44 change. Also, due to the change of the surfacing position of the shaft 3, the dimensions of the gap change. As a result, in spite of the magnetic permeability of the magnetic body targets 81, 82 remaining unchanged, the signals S2 change to the signals S2' due to the change of the dimensions of the gap, so that the temperature T can be mistakenly determined to exceed the Tc.

Also, as shown in FIG. 4(*a*), the magnetic permeability in the case of T>Tc differs greatly from the magnetic permeability in the case of T<Tc near the temperature Tc; however, the difference in the magnetic permeability in both cases near a normal temperature decreases. Therefore, the difference between a set threshold and the signal level in T>Tc decreases, so that the determination can be easily wrong due to the change of the signals S2 with the change of the dimensions of the gap.

Figure 11:
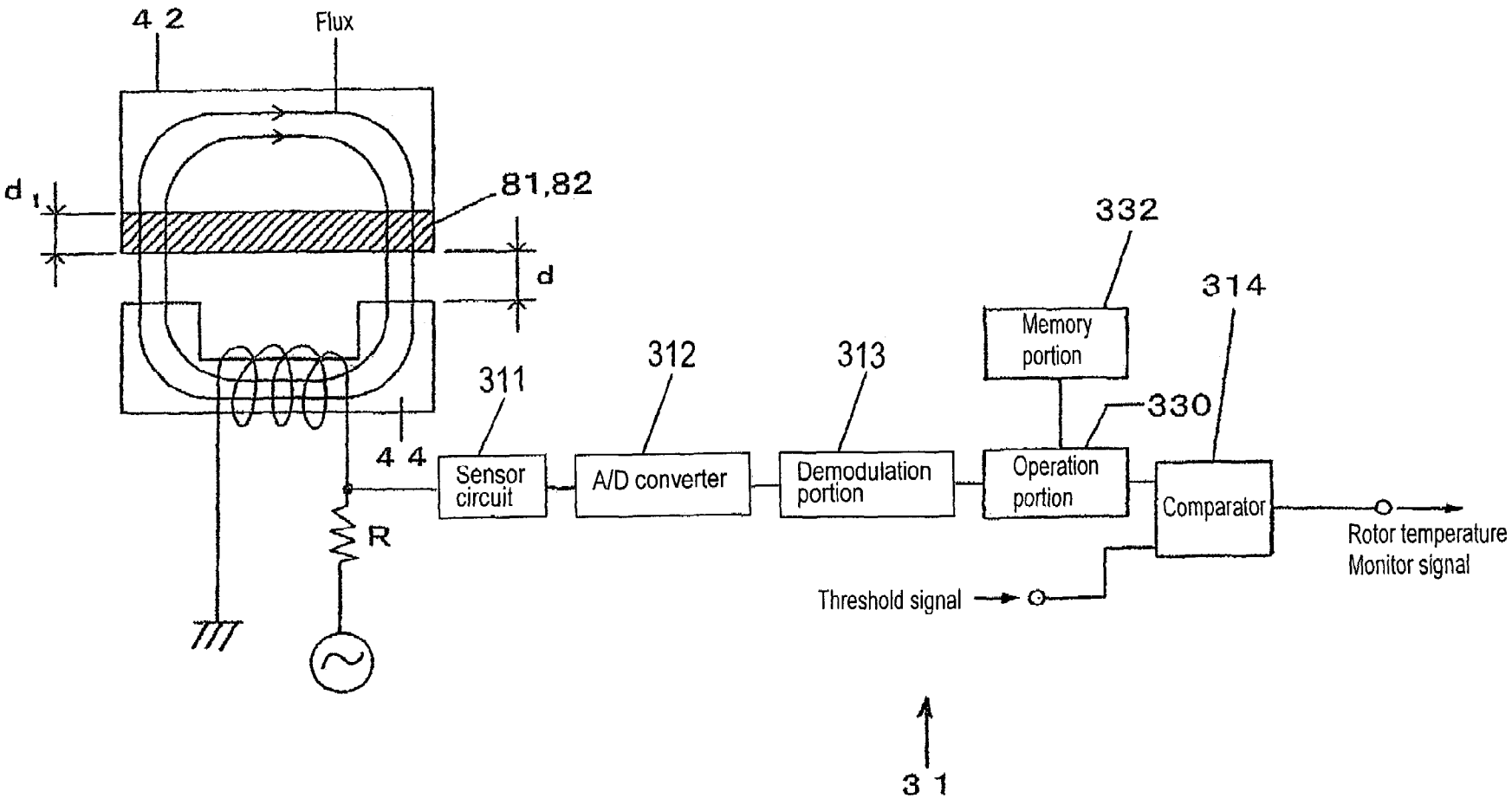
FIG. 11 is a block diagram showing details of the gap sensor 44 and the detecting portion 31 according to a second embodiment.

Consequently, in the second embodiment, in addition to the magnetic body targets 81, 82, the magnetic body including a sufficiently-higher Curie temperature than the allowable maximized temperature Tmax of the pump is provided as a target. Whether or not the rotor temperature T consists of T>Tc is determined based on the differential signal between the reference signal and the signals S1 concerning the magnetic body targets 81, 82, as the reference signal of the signal when the gap sensor 44 is opposed to the target. In this case, as shown in FIG. 11, an operation portion 330 is provided between the demodulation portion 313 and the comparator 314, and the operation portion 330 carries out the following signal processing.

Here, nut 42 is formed by the magnetic body with a sufficiently-high Curie temperature, and signal S1 when the gap sensor 44 is opposed to the fixed surface 42*a* is the reference signal. Also, a differential signal ΔS is ΔS=(signals of the magnetic body targets 81, 82)−S1. In the case wherein the dimensions of the gap increase due to a change in surfacing position, the output value of the sensor signal decreases. The shrinkage is shown by Δ.

Figure 12:
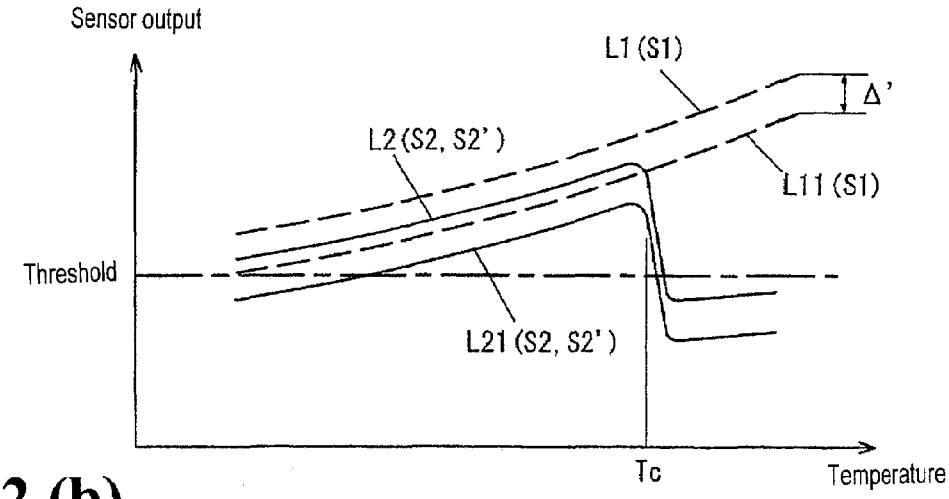
FIGS. 12(*a*) to 12(*c*) are graphs, wherein FIG. 12(*a*) show signals before the removal of a finite difference, FIG. 12(*b*) is a graph showing a differential signal, and FIG. 12(*c*) is a graph showing a derivative signal.
Figure 12:
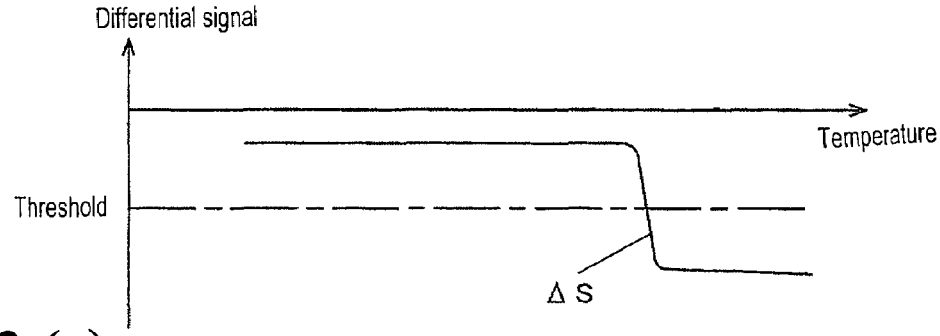
Figure 12:
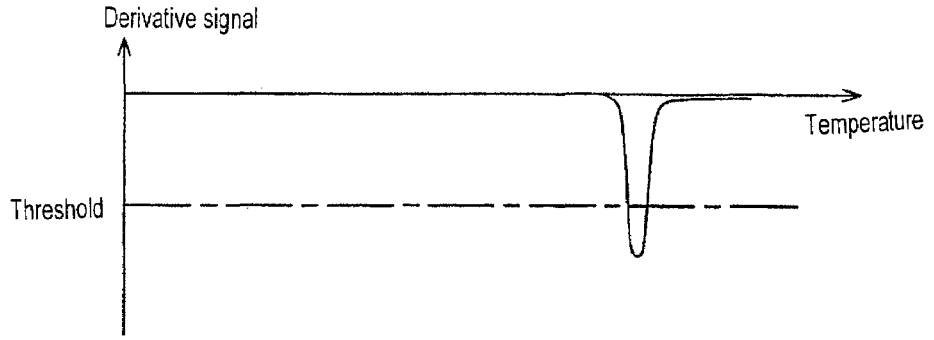

In FIG. 12(*a*), curved lines L1, L2 represent a signal S1 before the gap is changed and a signal (S2+S2'), and curved lines L11, L21 represent a signal S1 after the gap is changed and a signal (S2+S2'). Note that, since the signal (S2+S2') consists of the signal S2 whose part is lower than the Curie temperature and the signal S2' whose part is higher than the Curie temperature, in the curved lines L2, L21, the above-described symbols are used. In the room temperature portion whose temperature is lower than the Curie temperature Tc, the reference signal S1 has the same tendency to change as the signal S2. In values of the curved lines L11, L21, output values decrease only Δ' relative to the curved lines L1, L2 before the change. In the case of the curved line L21, in the room temperature portion of the curved line at the far left, the curved line L21 decreases less than the threshold level, so that the rotor temperature is mistakenly determined as the Curie temperature Tc.

The differential signal ΔS, from the detection signal (S2+S2') and the reference signal S1, is a signal wherein the curved line L1 is deducted from the curved line L2 before the gap change. Therefore, the shrinkage Δ' in the curved line L1 is cancelled from the curved line L2, by removing a finite difference, and the differential signal ΔS is never affected by the shrinkage Δ'. On the other hand, the differential signal ΔS after the gap change is a signal wherein the curved line L11 is subtracted from the curved line L21, and the shrinkage Δ' is cancelled by removing the finite difference in a similar fashion. As a result, the differential signal ΔS before the gap change is equal to the differential signal ΔS after the gap change. FIG. 12(*b*) shows the differential signal ΔS.

Herewith, the differential signal ΔS is used as the rotor temperature monitor signal in place of the signal S2, so that the Curie temperature of the magnetic body targets 81, 82 can be detected without being affected by the thermal expansion of the shaft 3 or the change of the surfacing position and the like. Also, in the case of the curved line L2 in FIG. 12(*a*), the signal decreases at the left-hand part of the curved line L2, so that the setting range of the threshold level is very narrow. Accordingly, as described above, at the room temperature part, the rotor temperature can be mistakenly determined. On the other hand, in the case of the differential signal ΔS shown in FIG. 12(*b*), the finite difference from the reference signal S1 which has the same tendency of changing at the room temperature part is removed, so that the tendency of decreasing on the left side of the curved line disappears. Accordingly, the setting range of the threshold stretches, and also an erroneous determination in the room temperature part can be prevented.

Note that, with respect to the threshold level, it is better to select a part wherein the change of the differential signal ΔS is the steepest. For example, in the case wherein the difference between the output level at the time of the room temperature and the output level at the time of a high temperature (after the change) in FIG. 12(*b*), is 1, threshold level is selected to 0.4-0.6. If the difference between an actual output level and the output level at the time of the high temperature drops to below 0.4~0.6, a warning of a rotor temperature rise is issued. If the threshold is too close to 1, a slight sensor output change can mistakenly issue the warning. Conversely, if the threshold is too close to 0, even if the rotor temperature exceeds the allowable temperature, the warning might not be issued.

Note that, as shown in FIG. 12(*c*), the derivative signal in FIG. 12(*b*) is calculated, and if the derivative signal becomes below a predetermined value, the rotor temperature may be determined as being higher than the allowable temperature (Curie temperature Tc). This predetermined value can be set based on the variation character of the magnetic permeability before and after the Curie temperature of the magnetic body material.

MODIFIED EXAMPLE 1

Figure 13:
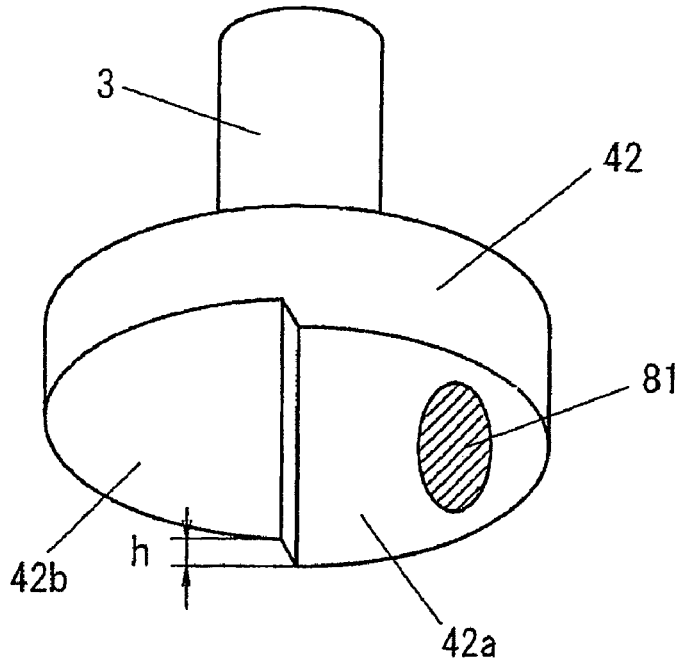
FIGS. 13(*a*) and 13(*b*) are drawings showing a modified example of a nut used in accordance with a second embodiment, wherein FIG. 13(*a*) is a perspective view of the nut 42, and FIG. 13(*b*) is a plan view of the nut 42.
Figure 13:
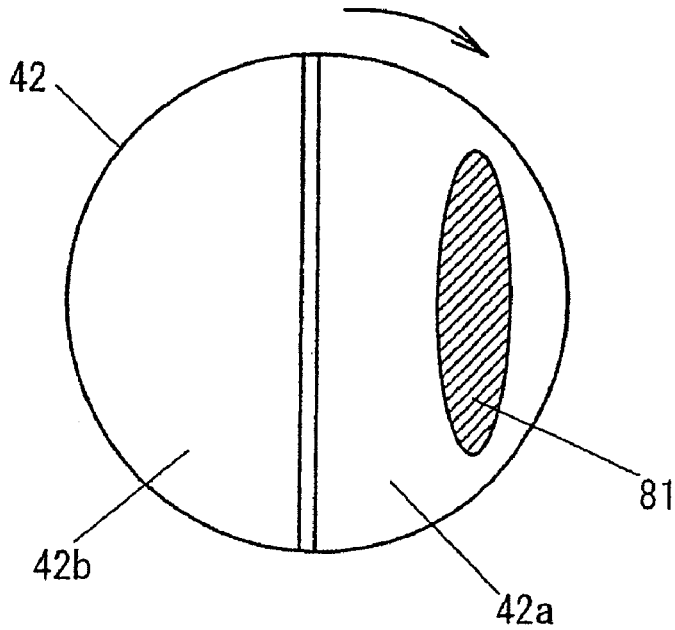
Figure 14:
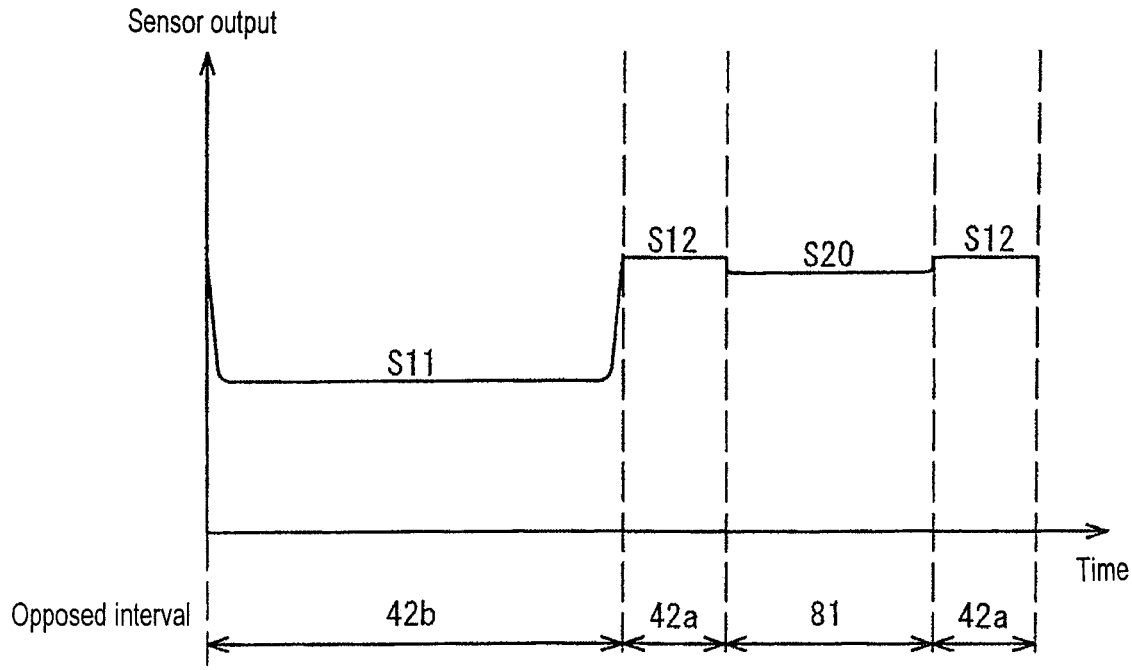
FIGS. 14(*a*) and 14(*b*) are graphs showing the sensor outputs in accordance with the modified nut example shown in FIGS. 13(*a*) and 13(*b*), wherein FIG. 14(*a*) shows a case of the T<Tc, and FIG. 14(*b*) shows a case of the T>Tc.
Figure 14:
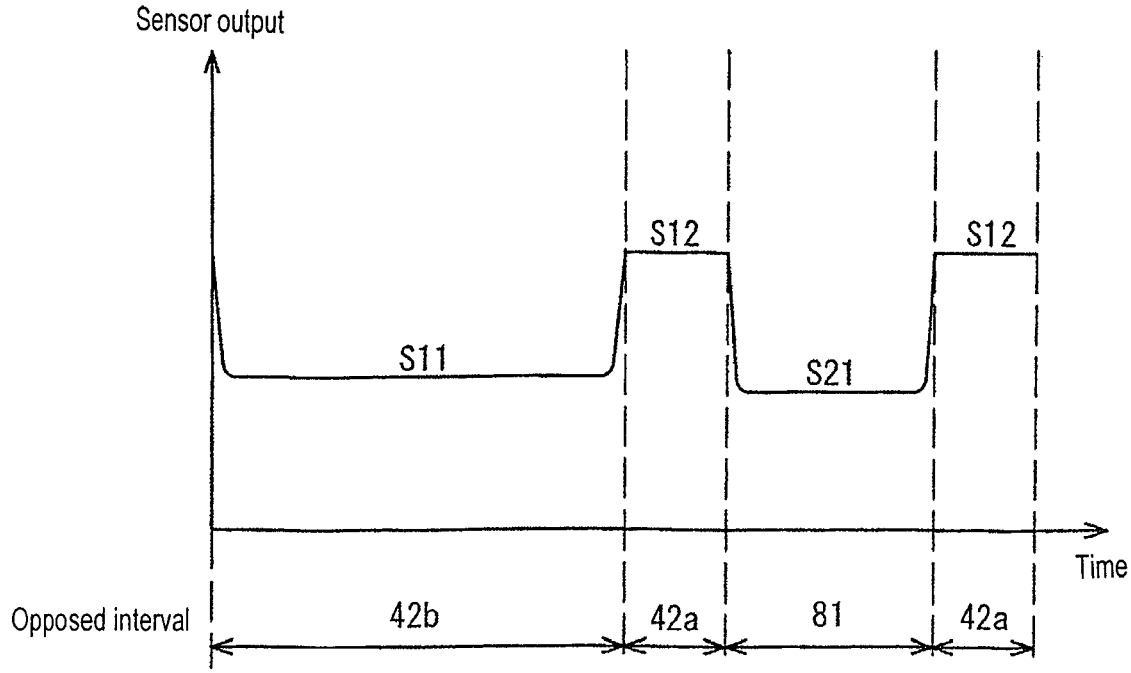

FIGS. 13(*a*) and 13(*b*) depict a modified example 1 of the second embodiment, and show nut 42 wherein the magnetic body target 81 is provided. There is a level difference with a height of h on the bottom face of nut 42, and the magnetic body target 81 is provided on the fixed surface 42*a* which is the higher side of the level. If nut 42 with the above-mentioned shape is used as a sensor target, when the rotor is rotated once, the sensor output as shown in FIGS. 14(*a*), 14(*b*) can be obtained. FIG. 14(*a*) shows the case of T<Tc, and FIG. 14(*b*) shows the case of T>Tc.

When nut 42 is opposed to magnetic body target 81, the sensor output becomes a signal S20 in the case of T<Tc, and in the case of T>Tc, the magnetic permeability changes and the level declines as a signal S21. Also, in the case wherein the gap sensor 44 is opposed to a fixed surface 42*b*, the size of the gap becomes larger just by the level difference size h compared to the case wherein the gap sensor 44 is opposed to the fixed surface 42*a*. Accordingly, a signal S11 has a lower output level than a signal S12. Note that, here, the level difference size h is set in such a way that a difference=S12−S11 equals a change=S20−S21.

In the modified example 1, in the case wherein the output signal when opposed to the fixed surface 42*a* is A; the output signal when opposed to the fixed surface 42*b* is B; and the output signal when opposed to the magnetic body target 81 is C, "MS=(C−B)/(A−B)" is used as a rotor temperature monitor signal MS. In the case of T<Tc in FIG. 14(*a*), A=S12, B=S11, C=S20, so that the signal MS becomes the following formula (15).

$$MS = (S20 - S11)/(S12 - S11) = (S20 - S11)/(S20 - S21) \quad (15)$$

On the other hand, in the case of T>Tc shown in FIG. 14(*b*), the signal MS is derived using the following formula (16).

$$MS = (S21 - S11)/(S12 - S11) = (S21 - S11)/(S20 - S21) \quad (16)$$

In the example shown in FIGS. 14(*a*), 14(*b*), since S20≈S12 is set, S21≈S11. In the case of T<Tc, MS≈1, and in the case of T>Tc, MS≈0. Thus, in the modified example 1, whether or not the rotor temperature exceeds the Curie temperature Tc is determined based on how much an output signal C is changed on the basis of a signal change by a magnetic permeability change=S20−S21. Therefore, the change of sensitivity of the sensor due to the gap can be ignored.

Figure 15:
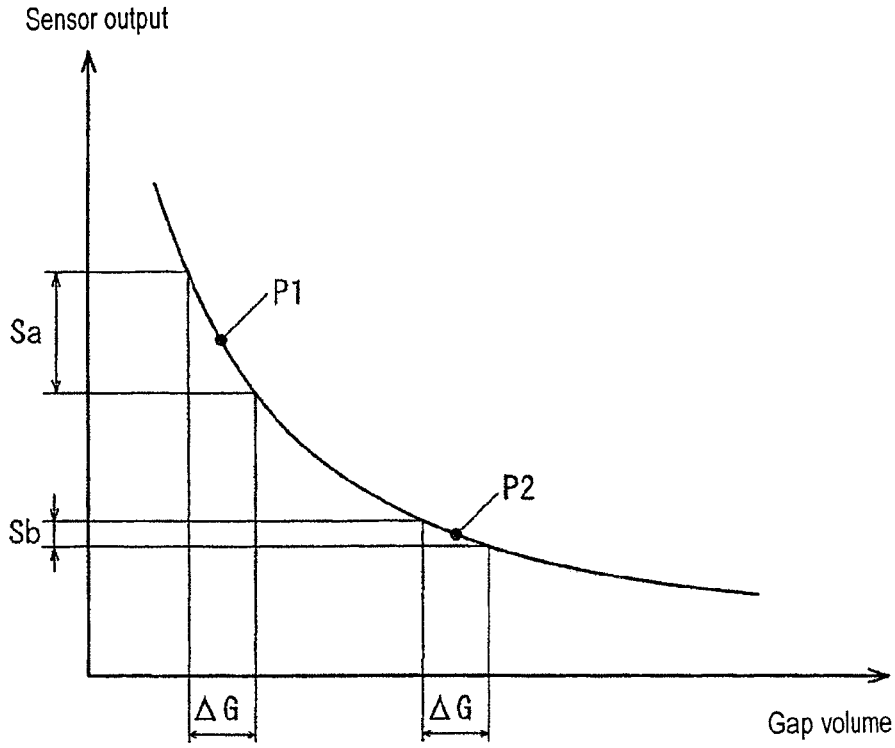
FIG. 15(*a*) is a graph showing a relationship between gap volume between the gap sensor 44 and the targets, and the sensor outputs, and FIG. 15(*b*) is a graph showing a correction coefficient.
Figure 15:
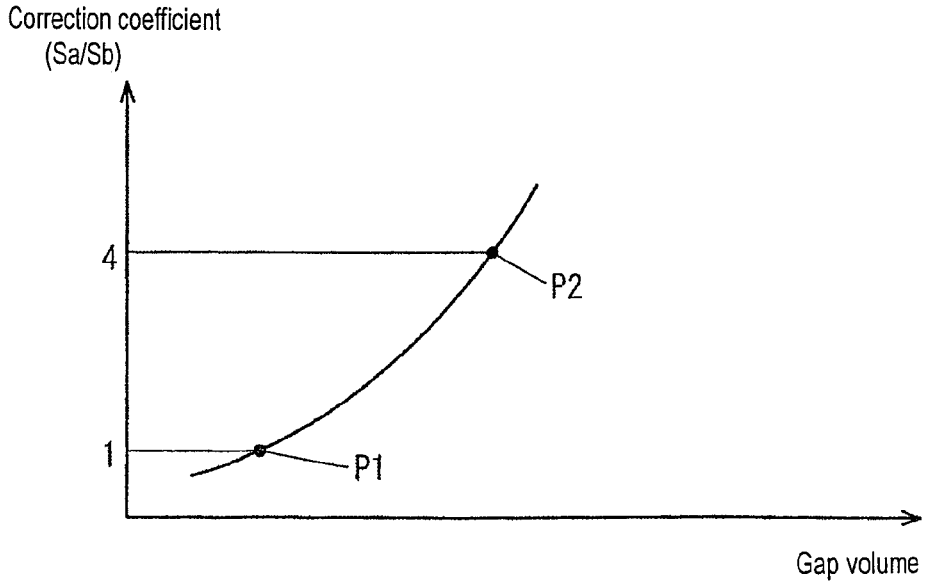

FIG. 15(*a*) shows the relationship between the gap volume between the gap sensor 44 and the targets, and the sensor outputs. The sensibility of the gap sensor 44 becomes duller as the gap volume becomes larger. As shown in FIG. 15(*a*), the larger the gap volume, the smaller the sensor output. Therefore, even if the gap volume changes ΔG appeared due to a magnetic permeability change of the magnetic body target 81 remains essentially the same, and the output change Sa when the nut 42 approaches the gap sensor 44 (a mark P1: small gap volume) becomes larger than an output change Sb when the nut 42 recedes from the gap sensor 44 (a mark P2: large gap volume).

Figure 16:
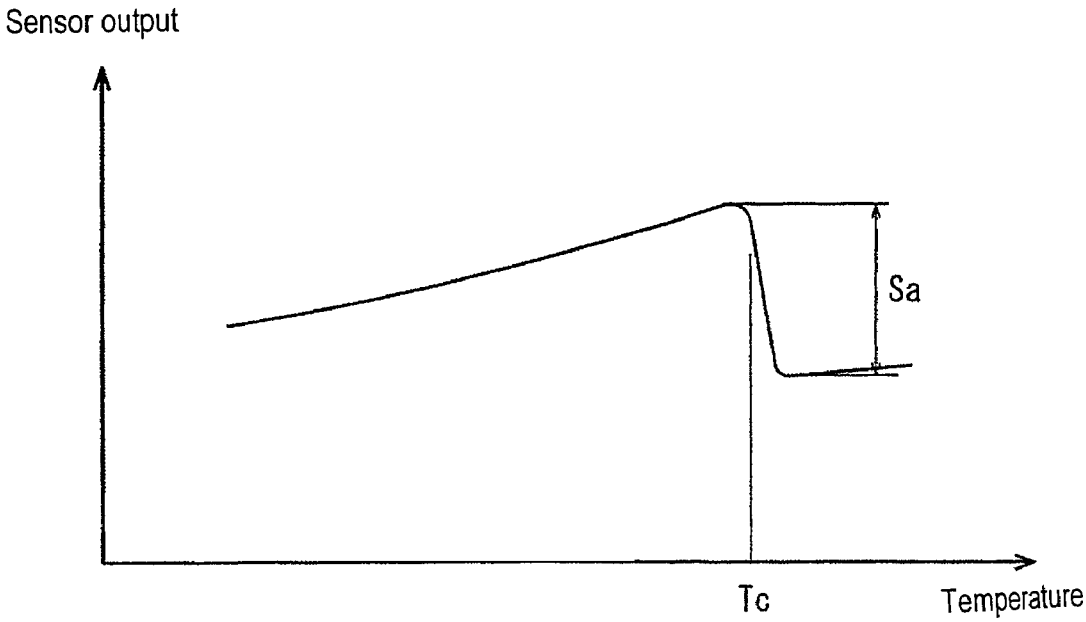
FIGS. 16(*a*) and 16(*b*) are graphs showing changes of the outputs by the change of the magnetic permeability, wherein FIG. 16(*a*) shows the sensor output in a dot P1, and FIG. 16(*b*) shows the sensor output in a dot P2.
Figure 16:
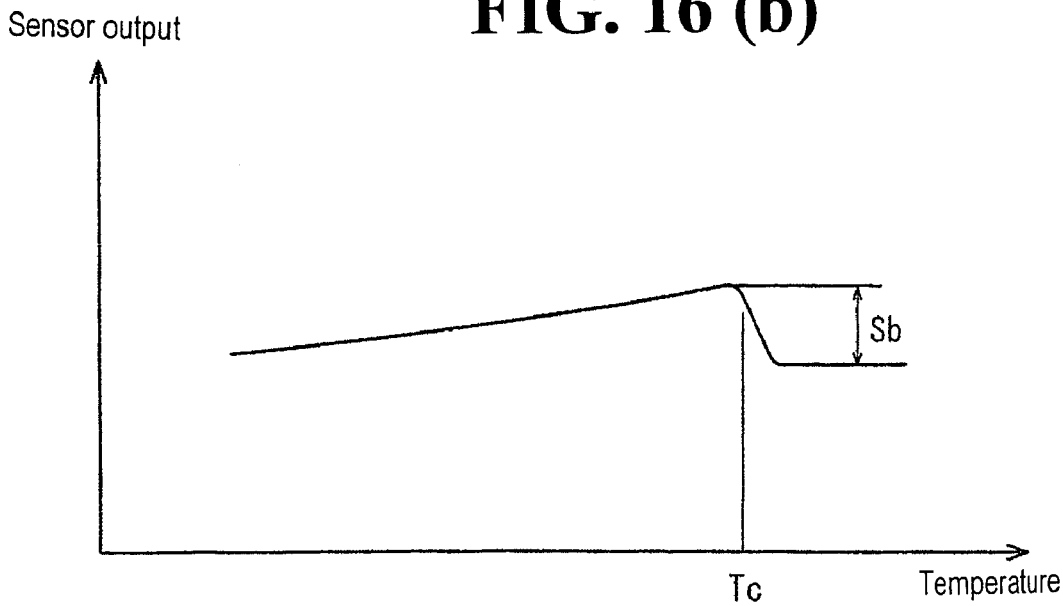

As a result, the output change due to the magnetic permeability change of the magnetic body target 81 is shown in FIGS. 16(*a*), 16(*b*). FIG. 16(*a*) shows a sensor output in the mark P1 in FIG. 15(*a*), and FIG. 16(*b*) shows the sensor output in the mark P2 in FIG. 15(*a*). When the sensor output change Sa becomes smaller as shown in FIG. 16(*b*), the setting range of the threshold level becomes narrow, so that the Curie temperature detection can be mistakenly determined. Also, in the case of removing the finite difference from the reference signal S1, the level difference of the sensor output in FIG. 12(*b*) becomes small, and the setting range of the threshold level also becomes narrow.

On the other hand, as in the modified example 1, in the case wherein the rotor temperature monitor signal MS is set in the "MS=(C−B)/(A−B)", when the gap volume becomes large and the sensor sensibility is lowered, the denominator, A−B also declines as is the case wherein the numerator, C−B declines. As a result, the signal MS is almost never affected by the decline of the sensitivity. For example, by setting in S20=S12, in the case of T<Tc, MS=1, and in the case of T>Tc, MS=0. Accordingly, the signal MS is never affected by the sensibility change. As a result, a temperature measurement with high precision can be possible.

Note that, in the above-mentioned example, the level difference h is set for S12−S11=S20−S21; however, it is not necessary to be set as stated above. Also, instead of setting the threshold level relative to the sensor output signal, and determining whether or not the allowable temperature is based on whether or not the sensor output intersects with the threshold level, as is the case with FIG. 12(*c*), whether or not to be the allowable temperature may be determined based on the derivative signal of the sensor output.

MODIFIED EXAMPLE 2

In the above-mentioned modified example 1, the level difference is provided on the bottom face of the nut, and the difference of the sensor output by the magnetic permeability change of the magnetic body target 81 is divided by the difference of the sensor output due to the level difference. Accordingly, nonlinearity of the sensor output is corrected. In the following modified example 2, the sensor output is corrected by using sensor characteristics which are determined in advance.

First, the sensor characteristics (sensor output−gap volume) as shown in FIG. 15(*a*) are determined in advance by measurement and the like. A correction coefficient is obtained from the sensor characteristics data, and the correction coefficient is stored on a memory portion 332 in FIG. 11. FIG. 15(*b*) shows the correction coefficient. Here, a sensor output Sa in the mark P1 is the basis and Sa/Sb is the correction coefficient. In the case of the sensor characteristics as shown in FIG. 15(*a*), since the correction coefficient in the mark P1 is Sa/Sa, the correction coefficient becomes 1. The correction coefficient in the mark P2 becomes 4 which is the amount wherein the Sa is divided by the output Sb of the mark P2.

For example, the correction coefficient Sa/Sb is multiplied by the signal level before the correction as shown in FIG. 16(*b*), and the signal is corrected as shown in FIG. 16(*a*). By using the above-mentioned correction coefficient, the sensor characteristics of the gap sensor 44 can be linearized, and the same effect as in the case of the modified example 1 can be obtained.

MODIFIED EXAMPLE 3

Due to effects of inductance or capacitance of a cable from the gap sensor 44 to the detecting portion 31, Since the detecting characteristics vary widely with respect to each pump, the carrier frequency fc may be maintained as low as possible even in order to prevent the variations. However, in the case wherein the carrier frequency fc is low, or the case wherein the sampling number in one rotation is few, the variations of the sensor output as shown in FIG. 6(*a*) occur due to a gap between magnetic bodies or a rapid change of the magnetic permeability. FIG. 6(*b*) is a drawing wherein multiple sensor outputs of magnetic body (magnetic body targets 81, 82) parts are overlapped, and the sensor outputs do not substantially vary in the roughly center position of the magnetic bodies; however, the sensor outputs of corresponding parts on both ends of the magnetic bodies vary widely.

In this case, if the sampling frequency fs is sufficiently larger than the rotational frequency, the same position can be sampled with respect to each rotation. As a result, the variation of the sensor output with respect to each rotation can be reduced. For example, if the sampling number in one rotation is 360 points with respect to each rotation, sampling can be carried out at one degree, so that a sampling phase shifting with respect to each rotation becomes within one degree, and the sensor output of a part wherein the output is stable can be extracted.

However, as mentioned above, in the case wherein the carrier frequency fc or the sampling frequency fs is set as low as possible, the variations of the sensor outputs cannot be avoided. Therefore, in the modified example 3, as a means of reducing the variations of the sensor output with respect to each rotation, averaging procedures are adopted. Specifically, multiple marks are sampled with respect to each magnetic body, and the averaging procedures are conducted for these sampled values for a long cycle of approximately 1 second. As a result, the signal such as FIG. 6(*c*) can be obtained.

Moreover, as shown in FIG. 6(*a*), when the signal of the central part in the range of the magnetic body detection, i.e., the central position of the magnetic body is sampled, the sensor output has few variations, so that the detection precision can be additionally improved by conducting the averaging procedures using only the sampling signal of the central part. Note that, in the above-mentioned example, the averaging span is approximately 1 second; however, since the temperature change is longer than the second, the averaging span can be approximately 1 minute. Also, in addition to simple averaging procedures, moving average, or removal of an AC variation component by the low-pass filter and the like may be conducted. As a result, sensor output with few variations can be obtained, and the temperature determination can be conducted with accuracy.

In the second embodiment, the following operational effect can be achieved.

(1) The magnetic body including the Curie temperature is provided as a basis target on a higher temperature side (T>Tmax) than the temperature monitoring range. A differential signal between the signal S1 when the gap sensor 44 is opposed to multiple magnetic body targets 81, 82; and a signal when the gap sensor 44 is opposed to the basis target are obtained, and whether or not the rotor temperature exceeds the predetermined temperature is determined based on the differential signal. As a result, the determination can be conducted without the effect of the thermal expansion of the shaft 3 or change of the gap, or like.

(2) Whether or not the rotor temperature exceeds the predetermined temperature can be determined more precisely by determining whether or not the derivative value of the differential signal is below the predetermined value.

(3) Also, the magnetic bodies (fixed surfaces 42*a*, 42*b*) wherein the Curie temperature is higher than the allowable temperature T max, and wherein the distance from the gap sensor 44 differs, are provided. The detection signal of the gap sensor 44 is corrected by using the differences (S11−S12) of the signals S11, S12 regarding the magnetic bodies 42*a*, 42*b*. As a result, the effect of the sensitivity change of the sensor due to the gap volume can be removed.

(4) The detection value of the gap sensor 44 is corrected by a correction parameter correcting the nonlinearity of the detecting characteristics of the gap sensor 44. As a result, as in the case of the above-mentioned (3), the sensitivity change of the sensor due to the gap volume can be removed.

(5) With respect to the opposing interval wherein the gap sensor 44 is opposed to the magnetic body targets 81, 82, the averaging procedures are conduced for signals obtained by the sampling during multiple rotations of the rotor. Accordingly, variations of the signals can be reduced, and precision of the temperature determination can be improved.

Note that, in the embodiments, a rotor temperature measurement of the turbo-molecular pump is explained as an example; however, the invention is not limited to the turbo-molecular pump, and can also be applied to various types of vacuum pumps such as a drag pump and the like. Also, the magnetic bodies are provided on the nut 42 provided at the lower end of the shaft 3; however, the arrangement position of the magnetic bodies is not limited to the above-mentioned position. For example, the magnetic bodies may be provided near the fastening part (upper end part of the shaft) of the shaft 3 and rotor 2, or on the rotor 2 itself. If there is an enough space to be able to arrange them, and if the magnetic bodies can bear a high-speed rotation in mechanical strength, the magnetic bodies can be provided in various places.

In response to the above-explained embodiments and factors of claims, the gap sensor 44 constitutes an inductance detecting means; the sine-wave discrete value generating portion 317, D/A converter 318, and filter 319 constitute the carrier generation means; the comparator 314 constitutes a determination means; and the operation portion 330 constitutes the averaging means, a differential generation means, signal correction means, derivative operation means, and nonlinearity correction means, respectively.

Note that, the above-described explanation merely exemplary of the invention is interpreted, it is not limited to or bound by a corresponding relationship between the listings of the embodiment and the listings of the claims.

The disclosure of Japanese Patent Application No. 2005-368241 filed on Dec. 21, 2005 is incorporated herein as a reference.

What is claimed is:

1. A vacuum pump which exhausts gas by rotating a rotor relative to a stator, comprising:

at least one magnetic body located on a circle about a rotor rotational axis, the magnetic body having a Curie temperature within a rotor temperature monitoring range;

an inductance detecting portion facing the circle so as to establish a gap between the circle and the inductance detecting portion, the inductance detecting portion being configured to detect a change of magnetic permeability of the magnetic body as an inductance change when the magnetic body rotates therepast;

carrier generation means generating a carrier signal for providing in the inductance detecting portion;

A/D conversion means sampling a detection signal of the inductance detecting portion synchronously with a carrier generation by the carrier generation means, and converting the detection signal to a digital signal; and determination means to which a digital signal from the A/D conversion means is input, the determining means determining whether or not a temperature of the rotor exceeds a predetermined temperature, based on the change of the magnetic permeability of the magnetic body detected by the inductance detecting portion, wherein a sampling frequency fs by the A/D conversion means meets fs=fc/n relative to a frequency fc of a carrier generated by the carrier generation means, and fs≧(f rotmax) meets relative to the maximum rotational frequency f rotmax of the rotor, where n=1/2, or $n=2^m$ and m is natural number.

2. A vacuum pump according to claim 1, wherein the sampling frequency fs meets fs≧(f rotmax)×(f div) when a detection point which should be detected at the inductance detecting portion is (f div), during one rotation of the rotor.

3. A vacuum pump according to claim 1, further comprising averaging means provided in an opposed interval, wherein the detecting portion obtains, in a length opposing the magnetic body, signals by sampling of the A/D conversion means during multiple rotations of the rotor, the average means averaging the obtained signals and allowing the obtained signals to be a signal of the opposed interval; and the determination means conducts determination based on the averaged signal by the averaging means.

4. A vacuum pump according to claim 1, further comprising:

a basis magnetic body provided in the circle and including a Curie temperature on a higher temperature side than the temperature monitoring range; and differential generation means generating:

(a) a first differential signal between a first detection signal when the at least one magnetic body is opposed to the inductance detecting portion, and a second detection signal when the basis magnetic body is opposed to the inductance detecting portion; or (b) a second differential signal between an after-conversion first detection signal after the first and second detection signals are converted by the A/D conversion means and an after-conversion second detection signal, wherein the determination means determines whether or not the temperature of the rotor exceeds the predetermined temperature based on the second differential signal or the first differential signal after converted by the A/D conversion means.

5. A vacuum pump according to claim 4, further comprising derivative operation means conducting a derivative operation of the differential signal or the after-correction detection signal, wherein the determination means determines whether or not the temperature of the rotor exceeds the predetermined temperature based on whether or not a result of an operation of the derivative operation means is below a predetermined value.

6. A vacuum pump according to claim 1, further comprising:

a pair of basis magnetic bodies provided in the circle in such a way that a distance between each basis magnetic body and the inductance detecting portion differs, and including a Curie temperature on the higher temperature side than a temperature monitoring range; and signal correction means generating (a) a first after-correction detection signal wherein a first detection signal when the at least one multiple magnetic body is opposed to the inductance detecting portion is corrected by difference of a pair of detection signals obtained when the pair of basis magnetic bodies is opposed to the inductance detecting portion; or (b) a second after-correction detection signal wherein the first detection signal after converted by the A/D conversion means is corrected by difference of the pair of detection signals after converted by the A/D conversion means, wherein the determination means determines whether or not the temperature of the rotor exceeds the predetermined temperature based on the second after-correction detection signal or the first after-correction detection signal after converted by the A/D conversion means.

7. A vacuum pump according to claim 1, further comprising nonlinearity correction means which has a correction parameter correcting a nonlinearity of a detecting characteristic of the inductance detecting portion, and correcting the detection signal of the inductance detecting portion, wherein instead of the detection signal of the inductance detecting portion, the detection signal corrected by the nonlinearity correction means is used.

8. A vacuum pump according to claim 1, wherein the at least one magnetic body is disposed in a rotatable body so that at least a portion of a lower face of the rotatable body juxtaposes the induction detecting portion and is spaced therefrom by the gap during at least part of the rotation of the rotatable body, and so that an exposed face of the at least one magnetic body is flush with the portion of the lower face of the rotatable body.

9. A vacuum pump according to claim 8, wherein the rotatable body is circular and the portion of the lower face of the rotatable body which faces the induction detecting portion and is spaced therefrom by the gap during at least part of the rotation of the rotatable body, is essentially hemi-circular.

* * * * *